US008562311B2

(12) United States Patent
Boyd, Jr. et al.

(10) Patent No.: US 8,562,311 B2
(45) Date of Patent: Oct. 22, 2013

(54) COMPRESSOR IMPROVEMENTS

(75) Inventors: John H. Boyd, Jr., Holland, MI (US); Upesh Patel, Auckland (NZ); Timothy Gordon Read, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 2396 days.

(21) Appl. No.: 10/856,149

(22) Filed: May 28, 2004

(65) Prior Publication Data

US 2005/0008512 A1 Jan. 13, 2005

Related U.S. Application Data

(60) Provisional application No. 60/480,757, filed on Jun. 23, 2003.

(30) Foreign Application Priority Data

May 30, 2003 (NZ) ..... 526361

(51) Int. Cl.
*F04B 35/04* (2006.01)
*F04B 39/12* (2006.01)

(52) U.S. Cl.
USPC ..... 417/417

(58) Field of Classification Search
USPC ..... 417/396–398, 415–419, 545–555.1
See application file for complete search history.

(56) References Cited

U.S. PATENT DOCUMENTS 2,222,203 A * 11/1940 Manseau ..... 417/415
3,143,281 A 8/1964 Dolz
3,490,684 A 1/1970 Rietveld et al.
3,947,155 A 3/1976 Bidol
4,416,594 A * 11/1983 Ichikawa ..... 417/360
4,430,856 A * 2/1984 Niedert ..... 60/272
4,644,851 A 2/1987 Young
4,755,108 A * 7/1988 Todescat et al. ..... 417/312
4,776,776 A * 10/1988 Jones ..... 417/560
4,854,839 A 8/1989 DiFlora
5,146,124 A 9/1992 Higham et al.
5,163,819 A 11/1992 Pettitt
5,174,735 A 12/1992 Gannaway
5,320,505 A 6/1994 Misiak et al.

(Continued)

FOREIGN PATENT DOCUMENTS

EP 1022464 1/2000
FR 1 180 821 6/1959

(Continued)

OTHER PUBLICATIONS

European Search Report dated Mar. 27, 2007 which issued in connection with European Application No. 970343; Four (4) pages.

*Primary Examiner* — Charles Freay
*Assistant Examiner* — Philip Stimpert
(74) *Attorney, Agent, or Firm* — Clark Hill PLC

(57) ABSTRACT

A linear compressor has a hollow piston with crown and sidewall. The piston reciprocates in a cylinder. A piston rod connects the piston to a spring. A connection between the piston rod and the piston transmits axial forces directly to the piston crown. The connection transmits lateral forces to the piston at an axial location away from the piston crown. The connection allows rotational flexibility between the piston and the piston rod transverse to and uniformly around the piston reciprocation axis.

Other improvements in or relating to linear compressors are disclosed and claimed.

13 Claims, 24 Drawing Sheets

(56) References Cited

U.S. PATENT DOCUMENTS

| | | | | |
|---|---|---|---|---|
| 5,525,845 | A | 6/1996 | Beale et al. | |
| 5,556,260 | A | 9/1996 | Takenaka et al. | |
| 5,577,898 | A | 11/1996 | Lee | |
| 5,772,410 | A * | 6/1998 | Chang | 417/363 |
| 6,089,352 | A | 7/2000 | Kim et al. | |
| 6,398,523 | B1 * | 6/2002 | Hur et al. | 417/417 |
| 6,506,032 | B2 | 1/2003 | Kawahara et al. | |
| 6,540,490 | B1 | 4/2003 | Lilie | |
| 6,817,846 | B2 * | 11/2004 | Bennitt | 417/523 |

FOREIGN PATENT DOCUMENTS

| | | | |
|---|---|---|---|
| GB | 1 222 425 | | 2/1971 |
| GB | 2 108 595 | | 5/1983 |
| GB | 171465 | | 8/1986 |
| GB | 2 246 176 | | 1/1992 |
| JP | 08303892 | | 11/1996 |
| JP | 09203379 | | 8/1997 |
| JP | 09222079 | | 8/1997 |
| JP | 11-117861 | | 4/1999 |
| RU | 2014502 | | 6/1994 |
| SU | 1525313 | | 11/1989 |
| SU | 2014502 | C1 * | 6/1990 |
| SU | 1678559 | | 9/1991 |
| WO | WO94/11635 | | 5/1994 |
| WO | WO 0032934 | | 6/2000 |
| WO | WO 0129444 | | 4/2001 |
| WO | WO 0235093 | | 5/2002 |
| WO | WO02/095233 | | 11/2002 |
| WO | WO03/044365 | | 5/2003 |

* cited by examiner

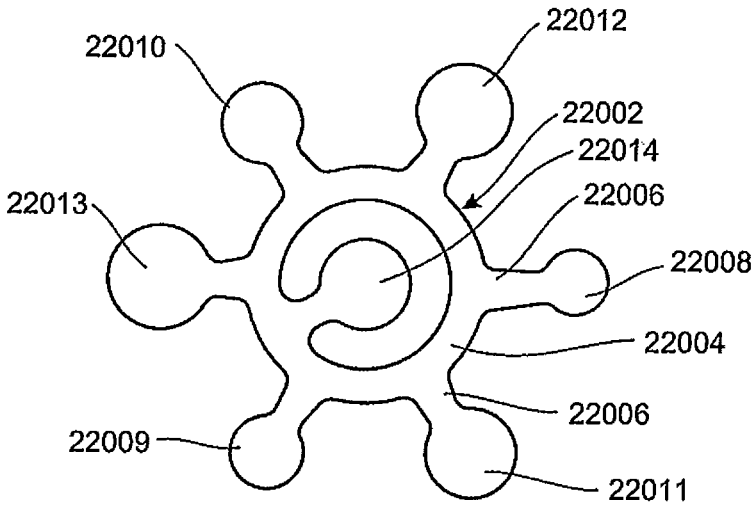
FIGURE 22
FIGURE 23
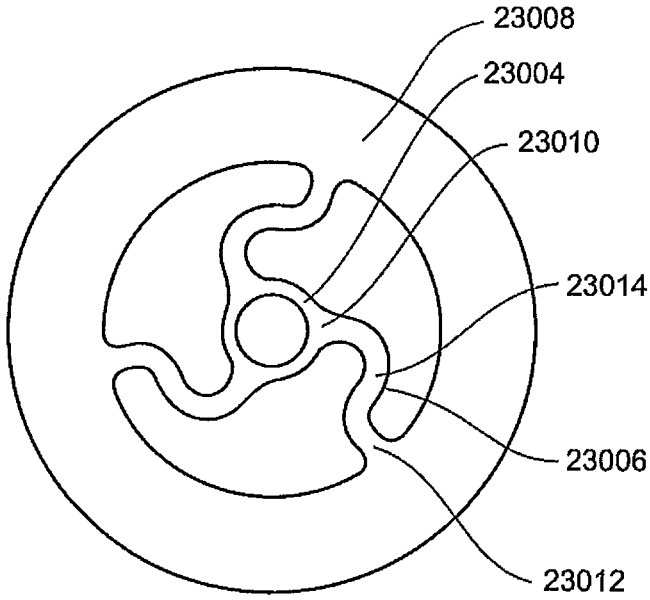

COMPRESSOR IMPROVEMENTS

CROSS-REFERENCE

This patent application claims the benefit of domestic priority of U.S. Provisional Application Ser. No. 60/480,757, filed Jun. 23, 2003, and entitled "Compressor Improvements".

BACKGROUND TO THE INVENTION

Field of the Invention

The present invention relates to a linear or free piston compressor, particularly but not solely for use in refrigerators.

SUMMARY OF THE PRIOR ART

The inventions disclosed in the present application relate to linear compressors and free piston machines. There are numerous examples of linear compressors and free piston machines in the prior art. A recent example is described in our international publication WO 02/35093. Our refrigeration compressor is described in that publication. The compressor includes a piston assembly reciprocal within a cylinder assembly. The piston assembly and cylinder assembly are connected by a main spring at a tail end of each assembly. A linear electric motor has a stator positioned between the cylinder and the main spring and an armature positioned between the piston and the main spring (on a connecting piston rod). The linear electric motor is energised to drive the compressor at a resonant frequency as required. The compressor is adapted for oil free operation, with gas bearings operating between the piston and cylinder walls and supplied with a compressed refrigerant from the cylinder head. The disclosure of WO 02/35093 is incorporated herein by reference, and is summarised at the beginning of the detailed description of the present application to place the present inventions in their preferred context.

However many of the present inventions are also applicable in other compressor configurations.

Our international publication WO 01/29444 shows a compressor configuration where the linear electric motor is provided concentrically with the piston and cylinder. In many other respects that compressor is similar to the compressor in WO 02/35093. U.S. Pat. No. 5,525,845, assigned to Sun Power Inc also describes an oil free linear compressor using gas bearings where the linear electric motor is provided concentric with the piston and cylinder, and a range of other configurations as well.

U.S. Pat. No. 6,089,352, assigned to LG Electronics Inc, describes a linear compressor where the linear electric motor is provided concentrically with the piston and cylinder. Oil lubrication is provided rather than gas bearings.

U.S. Pat. No. 4,416,594, assigned to Sawafuji Electric Company Limited, describes a linear compressor which uses oil lubrication. The armature of the linear electric motor surrounds the stator. A suction valve is provided in the piston head so that refrigerant for compression enters the compression space through the piston rather than through the cylinder head. Other examples which include suction through the piston head are shown in WO 00/32934, assigned to Matsushita Refrigeration Company and U.S. Pat. No. 3,143,281, by H Dölz.

All of the above are examples of resonant compressors including a spring between a piston part and a cylinder part.

This arrangement is typical of linear compressors for refrigerant compression such as might be used in an air conditioner or domestic appliance. Other prior art linear compressors are known which do not make use of such a spring connection. Typically these compressors are used in Stirling cycle cryogenic coolers where the refrigerant gas is alternately compressed and expanded within the same locale. U.S. Pat. No. 5,146,124 and U.S. Pat. No. 4,644,851, both assigned to Helix Technology Corporation, are both examples of such an arrangement.

SUMMARY OF THE INVENTION

It is an object of the present invention to provide improvements to a compact linear or free
piston compressor which goes some way to improving on the prior art or which will at least provide the industry with a useful choice.

Throughout this specification, and in the claims "centre of bending" means, for a member, the position at which the member experiences no bending moment when a shear force is applied between its ends, but the orientation of the ends is rigidly maintained. For a member, including various types of spring and coil spring, which has uniform bending stiffness (EI) along its length the centre of bending will be the midpoint between rotation resisting end supports. This will also be the case for members exhibiting a bending stiffness that is symmetric about the midpoint.

In a first aspect the present invention may broadly be said to consist in, in a linear compressor having a piston reciprocating in a cylinder, the piston including an outward wall surface ending at either end of said piston at an annular corner, the improvement comprising:

a region of said outward wall surface having a reduced radius at said corner, such that the average clearance between said cylinder and said piston is greater at a said corner than the minimum annular average clearance between said piston wall and said cylinder; such that said region of reduced radius at said corner provides lift when the piston is moving with said end surface leading.

Preferably in operation piston sliding in said cylinder is lubricated by gas bearings.

Preferably said average clearance at said corner is greater than the median clearance between said piston outward wall surface and said cylinder.

Preferably a said region of reduced radius is annular.

Preferably in a said annular region said average clearance is between 0.1 and 4 times the said minimum annular average clearance for the majority of said piston wall surface. Most preferably in a said annular region said average clearance is between 0.25 and 2 times the said minimum annular average clearance for the majority of said piston wall surface.

Preferably a said annular region extends axially along said piston outward wall surface for a distance between 500 and 2000 times said minimum annular average clearance.

Preferably in a said annular region said reduction of diameter varies, being maximum at said corner and minimum at the edge of said annular region away from said corner, where said annular region meets with a region of said outward wall surface having said minimum annular average clearance.

Preferably said outward wall surface of said piston includes a said region of reduced radius at each said corner.

In a further aspect the present invention may broadly be said to consist in a method of manufacturing a piston for a gas bearing lubricated linear compressor, said method comprising the steps of:

making a piston body including an outward wall surface suitable for controlled corrosion, immersing an end of said piston body in an electrolyte for eroding said outward wall surface (eg: by electrolysis or chemical reaction), and withdrawing said piston body end from said electrolyte.

Preferably step (a) includes making said piston body with a plated metal layer of a certain thickness on its outward surface, and said end of said piston is immersed for a time and under such conditions that said metal layer is partially but not completely removed from an annular region of said outward wall surface.

Preferably the total time of immersion of said piston outward surface varies with position along said outward surface from said piston end, being greatest at said piston end, and substantially less at locations in said annular region further from said end.

Preferably said time of immersion is varied by steadily reciprocating said piston end into and out of said electrolyte. Said piston end may be repeatedly reciprocated into and out of said electrolyte.

In a further aspect the present invention may broadly be said to consist in, in a linear compressor having a piston, with crown and sidewall, reciprocating in a cylinder with a piston rod connecting said piston to a spring, the improvement comprising:

a connection between said piston rod and said piston that transmits axial forces directly to said piston crown and lateral forces to said piston at an axial location away from said piston crown, and that allows rotational flexibility between said piston and said piston rod transverse to, and uniformly around, the piston reciprocation axis.

Preferably in operation movement of said piston within said cylinder is lubricated by gas bearings.

Preferably said connection includes an axially stiff, laterally compliant link between said piston rod and said piston crown, and a lateral loading member connected with said piston rod and extending to the inner surface of the sidewall of said piston at an axial location intermediate along the length of said link, to transmit lateral forces to the inner surface of said piston sidewall.

Preferably said lateral loading member includes a rigid flange from connected with said piston rod, and a bearing fixed to the periphery of said flange abutting said inner surface of said piston side wall and allow for relative movement there between.

Preferably said bearing is elastomeric and allows movement by flexing. Alternatively said bearing is slippery, and allows movement by sliding.

Alternatively said lateral loading member includes a flexible diaphragm or spokes extending from said piston rod to said inner surface of said piston side wall, the periphery of said diaphragm being connected to said inner surface.

Alternatively said piston includes a cantilever member extending axially from said piston crown toward said piston rod, said and said lateral loading member transmits lateral loads to said cantilever member.

Preferably said cantilever member and said lateral loading member meet, one within the other, with a bearing between them that transmits lateral loads but permits relative rotation.

Alternatively said connection includes:

a cantilever extending from the inner surface of said piston crown with a distal end extending toward said piston rod, an extension from said piston rod with a distal end extending into said piston, and a joint between said cantilever and said piston rod extension which transmits axial and lateral loads, but allows relative rotation about axes transverse to the direction of reciprocation of the piston.

Preferably said joint comprises a body of elastomeric material interposed between the distal end of said cantilever and the distal end of said extension, and bonded one face to said cantilever and another face to said extension.

Alternatively said joint comprises a ball joint.

In a further aspect the present invention may broadly be said to consist in, in a linear compressor having a piston, with crown and sidewall, reciprocating in a cylinder with a piston rod connecting said piston to a spring, the improvement comprising:

an axially stiff, laterally compliant link between said piston rod and said piston crown, and a lateral loading member connected with said piston rod and extending to the inner surface of the sidewall of said piston at an axial location intermediate along the length of said link, to transmit lateral forces to the inner surface of said piston sidewall.

Preferably said lateral loading member includes a rigid flange from connected with said piston rod, and a bearing fixed to the periphery of said flange abutting said inner surface of said piston side wall and allow for relative movement there between.

Preferably said bearing is elastomeric and allows movement by flexing.

Alternatively said bearing is slippery, and allows movement by sliding.

Alternatively said lateral loading member includes a flexible diaphragm or spokes extending from said piston rod to said inner surface of said piston side wall, the periphery of said diaphragm being connected to said inner surface.

Alternatively said piston includes a cantilever member extending axially from said piston crown toward said piston rod, said and said lateral loading member transmits lateral loads to said cantilever member.

Preferably said cantilever member and said lateral loading member meet, one within the other, with a bearing between them that transmits lateral loads but permits relative rotation.

In a further aspect the present invention may broadly be said to consist in, in a linear compressor having a piston, with crown and sidewall, reciprocating in a cylinder with a piston rod connecting said piston to a spring, the improvement comprising:

a cantilever extending from the inner surface of said piston crown with a distal end extending toward said piston rod, an extension from said piston rod with a distal end extending into said piston, and a joint between said cantilever and said piston rod extension which transmits axial and lateral loads, but allows relative rotation about axes transverse to the direction of reciprocation of the piston.

Preferably said joint comprises a body of elastomeric material interposed between the distal end of said cantilever and the distal end of said extension, and bonded one face to said cantilever and another face to said extension.

Alternatively said joint comprises a ball joint.

In a further aspect the present invention may broadly be said to consist in, in a refrigeration compressor including a linear compressor resiliently supported in a hermetic shell, the arrangement of said compressor giving an expectation of cyclical movement on a substantially constant axis, the improvement comprising:

a supply path extending between said linear compressor and said shell, said supply path formed to be a loop lying within a plane parallel to the axis of said expected cyclical movement, with ends of said loop being substantially parallel and mounted respectively to said compressor and to said shell so as to resist moment about an axis perpendicular to said plane.

Preferably said ends of said supply path are mounted parallel to the expected axis of movement of said compressor.

Preferably said supply path is an electrical supply path to a linear electric motor and includes a wire formed to be a loop with a pair of substantially parallel sections, spaced apart and connected at distal ends by a transverse section, distal ends of said parallel sections being mounted respectively to said compressor and to said shell.

Preferably said transverse section of said loop is longer than the distance between the said distal end of either said parallel section and its respective mounting.

In a further aspect the present invention may broadly be said to consist in a housed compressor comprising:

a compressor having mounting connections on an assembly whose centre of mass oscillates substantially within a plane in operation of the compressor, a shell encapsulating said compressor, and a plurality of support members with low bending stiffness connecting between said mounting connections and said shell, said support members providing a vertical support for said compressor, each said support member being connected at one end to a said compressor mounting point and at the other end to said shell and having a "centre of bending" therebetween, the centre of bending of each support member being coplanar with said plane of oscillation.

Preferably each said support member is a coil spring, the bending stiffness of each said coil spring is symmetric about a midpoint, and the midpoints of said coil springs are coplanar with said plane of oscillation.

Preferably each said coil spring has a centre line and extends from said shell to said compressor with said centre-line perpendicular to said axis of piston reciprocation.

Preferably said linear compressor is substantially symmetric across said plane of oscillation, and said mounting connections on said assembly are above said plane, and the springs mount to said shell below said plane.

Preferably said mounting connections are outside the periphery of the compressor and said support springs are shorter than the height of said compressor.

In a further aspect the present invention may broadly be said to consist in a housed compressor comprising:

a compressor having mounting connections on an assembly whose centre of mass oscillates substantially within a plane in operation of the compressor, a hermetic shell encapsulating said compressor, and a plurality of coil support springs with low bending stiffness connecting between said mounting connections and said shell, said support members providing a vertical support for said compressor, each said support member being connected at one end to a said compressor mounting point and at the other end to said shell (in a moment transferring connection), the placement of springs between said compressor and said housing, and the bending stiffness profile and length of each spring being such that the vertical load supported by each support spring when the compressor is operating is substantially constant (and the same as when the compressor is not operating).

Preferably each said coil spring is connected at one end to a said compressor mounting point and at the other end to said shell and has a "centre of bending" therebetween, and the centre of bending of each support member being coplanar with said plane of oscillation.

Alternatively two or more said springs connect to said compressor as a set at a common axial position and the nett reaction torque applied to said compressor (when the compressor is oscillating) from said spring set is zero.

Preferably said spring set includes two springs opposed and symmetric across said plane of oscillation.

Preferably said oscillation is linear and said spring set includes at least three springs aligned radially relative to the line of oscillation.

In a further aspect the present invention may broadly be said to consist in a housed compressor comprising:

a shell, a linear compressor suspended within and enclosed by said shell with a gases space within said shell surrounding said linear compressor, said linear compressor having a piston reciprocable in a cylinder and a suction gases pathway from said gases space into said cylinder, a suction gases inlet to said shell gases space, a compressed gases path from said cylinder out of said shell, and a gas flow inhibitor in said gases space, substantially dividing a first region of said gases space from a second region of said gases space, and inhibiting gases flow between said first and second regions, said suction gases inlet and said suction gases pathway opening to said first region, and said compressed gases path passing through said second region.

Preferably said gas flow inhibitor comprises an annular constriction in said gases space.

Preferably said shell is a generally elongate vessel and includes a neck part way along its length, the inner surface of said shell being closer to said linear compressor in the region of said neck than in said first and second regions.

Preferably said suction gases pathway extends through said piston.

Preferably said compressed gases path includes a discharge head connected with said linear compressor, said discharge head including an inner wall surface defining a discharge gases chamber, an outer wall surface within said second region of said gases space, and thermal insulation between said inner surface and said outer surface.

Preferably said thermal insulation comprises a substantially enclosed space between an inner wall and an outer wall, said enclosed space having one spatial dimension sufficiently small that said space, together with the properties of the working gas and the expected operating conditions give a Rayleigh number (Ra) less than 20,000.

Preferably said cylinder includes:

a cylinder housing defining a cylinder wall, a valve plate defining a cylinder end and including one or more discharge openings to said compressed gases pathway, and thermal insulation sandwiched between said valve plate and said cylinder housing.

Preferably said thermal insulation comprises a thick polymeric sealing gasket.

In a further aspect the present invention may broadly be said to consist in a compressor including a piston reciprocating in a cylinder, with a suction gases pathway through said piston, and said cylinder including:

a cylinder housing defining a cylinder wall, a valve plate defining a cylinder end and including one or more discharge openings to said compressed gases pathway, and thermal insulation sandwiched between said valve plate and said cylinder housing.

Preferably said thermal insulation comprises a thick polymeric sealing gasket.

In a further aspect the present invention may broadly be said to consist in a compressor including a piston reciprocating in a cylinder without oil lubrication, with a suction gases pathway through said piston, and said cylinder including:

a cylinder housing defining a cylinder wall, a valve plate defining a cylinder end and including one or more discharge openings to said compressed gases pathway, and a thick polymeric sealing gasket sandwiched between said valve plate and said cylinder housing.

In a further aspect the present invention may broadly be said to consist in a housed compressor comprising:

a shell, a compressor suspended within and enclosed by said shell with a gases space within said shell surrounding said compressor, said compressor having a piston reciprocable in a cylinder and a suction gases pathway from said gases space into said cylinder, a suction gases inlet to said shell gases space, a compressed gases path from said cylinder out of said shell including a discharge head connected with said linear compressor, said discharge head having an inner wall surface defining a discharge gases chamber, an outer wall surface within said second region of said gases space, and thermal insulation between said inner surface and said outer surface.

Preferably said thermal insulation comprises an enclosed gases space between an inner wall and an outer wall, said gases space having one spatial dimension sufficiently small that said space, together with the properties of the working gas and the expecte operating conditions give a Rayleigh number (Ra) less than 20,000

Preferably said suction gases pathway avoids said discharge head.

In a further aspect the present invention may broadly be said to consist in in a compressor having a single cylinder with an enclosed end defining a compression space, with a piston reciprocating in said single cylinder, the improvement comprising:

a plurality of gas flow paths from said compression space to a discharge space, a self operating valve in each said gases flow path, opening under the influence of the prevailing pressure differential across the valve, and being biased to a closed condition by a spring each said valve and spring being part of a single unitary planar valve member.

Preferably each said valve and spring has a different natural frequency from the other said springs Preferably each said spring has a slightly different stiffness from other said springs.

Preferably said springs are a cantilever leaf spring, said valves are an end of said cantilever leaf spring, and the geometry of each said cantilever leaf spring is slightly different to the geometry of the other said cantilever leaf springs.

Alternatively each said valve has a slightly different mass from the other said valves.

Preferably said valve member has a common support member fixed relative to said closed end of said cylinder, with said plurality of cantilever leaf springs extending from said common support member.

Preferably said common support member is a central hub and said cantilever leaf springs extend radially from said hub.

Preferably there is a further cantilever leaf valve within said central hub.

In a further aspect the present invention may broadly be said to consist in, in a compressor including a piston reciprocating in a cylinder with an enclosed end defining a compression space, the product of the maximum stroke of said piston and the cross sectional area of the cylinder being less than 15 cc, the improvement comprising:

at least three gases flow paths from said compression space to a discharge outlet, a self operating valve in each said gases flow path, opening under the influence of the prevailing pressure differential across the valve.

Preferably each said valve is biased to a closed condition by a spring and each said valve and spring has a different natural frequency from other said valve and springs Preferably each said spring has a slightly different stiffness from other said springs.

Preferably said springs are a cantilever leaf spring, said valves are an end of said cantilever leaf spring, and the geometry of each said cantilever leaf spring is slightly different to the geometry of the other said cantilever leaf springs.

Alternatively or as well, each said valve has a slightly different mass from the other said valves.

Preferably said springs are formed as part of a single unitary valve member, said valve member having a common support member fixed relative to said closed end of said cylinder, with said plurality of cantilever leaf springs extending from said common support member.

Preferably said common support member is a central hub and said cantilever leaf springs extend radially from said hub.

Preferably there is a further cantilever leaf valve within said central hub.

In a further aspect the present invention may broadly be said to consist in, in a compressor including a piston reciprocating in a cylinder with an enclosed end defining a compression space, the improvement comprising:

a plurality of gases flow paths from said compression space to a discharge outlet, a self operating valve in each said gases flow path, opening under the influence of the prevailing pressure differential across the valve, each valve being biased to a closed condition by a spring, the natural frequency of each said spring and valve not all being the same (intentionally, whether by assembly or by form or valve, spring or other component).

Preferably each said valve and spring has a different natural frequency from all of the other said springs Preferably each said spring has a slightly different stiffness from other said springs.

Preferably said springs are a cantilever leaf spring, said valves are an end of said cantilever leaf spring, and the geometry of each said cantilever leaf spring is slightly different to the geometry of the other said cantilever leaf springs.

Alternatively or in addition, each said valve has a slightly different mass from the other said valves.

Preferably said springs are formed as part of a single unitary valve member, said valve member having a common support member fixed relative to said closed end of said cylinder, with said plurality of cantilever leaf springs extending from said common support member.

Preferably said common support member is a central hub and said cantilever leaf springs extend radially from said hub.

Preferably there is a further cantilever leaf valve within said central hub.

In a further aspect the present invention may broadly be said to consist in, in a compressor including a piston reciprocating in a cylinder with an enclosed end defining a compression space, the improvement comprising:

a plurality of gases flow paths from said compression space to a common discharge outlet, the said flow paths not all having the same length.

Preferably each said gases flow path includes a self operating valve, opening under the influence of the prevailing pressure differential across the valve.

Preferably each said flow path includes a shared discharge path with a common outlet from said shared discharge path, each said flow path including a portion of said discharge path, said portions of said discharge path included in said flow paths not all having the same length.

Preferably all of said portions of said discharge path included in said flow paths are of different length.

Preferably said shared discharge path is annular, but incomplete, and said flow paths open into said shared discharge path at positions dispersed around its annulus.

Preferably said common outlet is at one end of said annulus.

Preferably said common outlet opens to an exit passage within the curve of said annulus.

Preferably said shared discharge path includes a plurality of chambers connected by openings between adjacent chambers, and each said flow path opens to a different said chamber.

Preferably there is a central flow path opening directly into said exit passage.

Preferably said self operating valves operate to close the openings of said flow paths into said shared discharge path.

Preferably said compression space is enclosed at one end by a valve plate, said flow paths pass through said valve plate, said flow path openings are spaced on said valve plate so as to have a common radius relative to an axis passing perpendicularly through said valve plate, and a cover fixed to said valve plate, having internal walls defining a plurality of axial chambers distributed around a central axial exit passage, said chambers and exit passage being open toward said valve plate, with the wall defining said exit passage and at least one wall between adjacent chambers meeting said valve plate.

In a further aspect the present invention may broadly be said to consist in a planar valve member comprising:

a hub for securement to a valve plate, an annulus around said hub, spaced from said hub, and a plurality of spokes extending between said hub and said annulus at intervals around said hub.

Preferably there are three or five said spokes.

Preferably each said spoke is serpentine, and is significantly longer than the radial distance between said hub and said annulus.

Preferably there are three said spokes, with each spoke having a hub end and an annulus end, said ends joining the respective hub and annulus substantially perpendicular thereto.

In a further aspect the present invention may broadly be said to consist in, in a compressor including a piston reciprocating in a cylinder with a closed end defining a compression space, the improvement comprising a suction inlet to said compression space comprising:

a plurality of passages through said piston exiting said face of said piston at spaced apart locations, and a planar valve member having a hub secured centrally to the face of said piston and extending to cover said passage exits.

Preferably said planar valve member has an annulus around said hub and a plurality of spokes extending between said hub and said annulus at intervals around said hub.

Preferably said annulus covers said passage exits, and the outer edge of said annulus is spaced from the wall of said cylinder.

Preferably the number of spokes said valve member has is selected from the set: 3,5.

Preferably each said spoke is serpentine, and is significantly longer than the radial distance between said hub and said annulus.

Preferably there are three said spokes, with each spoke having a hub end and an annulus end, said ends joining the respective hub and annulus substantially perpendicular thereto.

In a further aspect the present invention may broadly be said to consist in a housed compressor comprising:

an elongate compressor, and an elongate hollow shell surrounding said compressor, the outer surface of said shell having at least one significant annular hollow transverse to the axis of elongation, with said elongate compressor supported within said shell so that it passes said hollow.

Preferably said shell is divided by said hollow into a first lobe and a second lobe, said hollow defining a waist joining said lobes, said waist being narrower than said lobes.

Preferably said compressor is a linear compressor, there is a gases space within said shell surrounding said linear compressor, said linear compressor has a piston reciprocable in a cylinder and a suction gases pathway from said gases space into said cylinder, there is a suction gases inlet to said shell gases space in said first lobe of said shell and a compressed gases path from said cylinder out of said shell through said second lobe of said shell.

In a further aspect the present invention may broadly be said to consist in a compressor including:

a piston having a side wall and an enclosing end, with a suction gases path through said enclosing end to a compression space, a chamber within said piston, said suction gases path leaving said chamber, and a first baffle defining a restricted entrance to said chamber at the end of said piston opposite said enclosing end.

Preferably there is a second baffle within said chamber, defining a first sub-chamber together with said piston side wall and said enclosing end, defining a second chamber together with said first baffle and said piston side wall, with a suction inlet past or through said second baffle.

Preferably said first baffle comprises a hollow enclosure supported within said piston opposite end, said suction inlet comprises an annular flow path between said piston sleeve and said hollow enclosure, and an entrance to said hollow enclosure has an opening onto said annular flow path.

Preferably said entrance to said hollow enclosure comprises a resonant tube, and the length and area of said resonant tube and the internal volume of said hollow enclosure are selected to provide a Helmholtz resonator tuned to remove an otherwise exhibited frequency component.

Preferably there is a valve member fixed to said piston end in said compression space, said valve member self operating under prevailing gases pressures and dynamic forces, and said passage through said first baffle and/or said annulus about said hollow have length and area selected to provide a compression pulse just as the piston begins a compression stroke.

Preferably a piston rod extends into said piston and said hollow enclosure is supported on said piston rod, supported out of contact with said piston sleeve such that said annular flow path surrounds said hollow enclosure.

Preferably said piston rod connects to said enclosing end of said piston, said first baffle extends from said piston rod to the inner surface of said piston sleeve, and is configured to transmit lateral loads but to isolate changes in orientation.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

FIG. 22 is a plan view of a multi valve planar valve member according to one embodiment of a further invention herein.

FIG. 23 is a plan view of a planar valve member according to another invention herein.

DETAILED DESCRIPTION

General Configuration of an Example Prior Art Compressor

The present application includes a number of inventions developed in relation to linear compressors and free piston machines. Each invention may be applicable to a wide range of compressor configurations, such as, but not limited to, those that are described herein and those that are known in the prior art. Not all of the improvements disclosed herein will be applicable to all types of compressors. For example improvements relating to gas bearing performance will be more useful improvements in compressors that make use of gas bearings, and improvements related to main springs and the connection thereof to the piston will not find a use in Stirling cycle compressors lacking such connecting springs.

To place the present inventions in an appropriate context the construction and arrangement of the compressor disclosed in WO 02/35093 is firstly described with reference to FIGS. 1 to 5. This is for convenience and is not an indication that the present inventions are applicable only to such an arrangement, but each improvement can be applied to a compressor of this general form.

Figure 1:
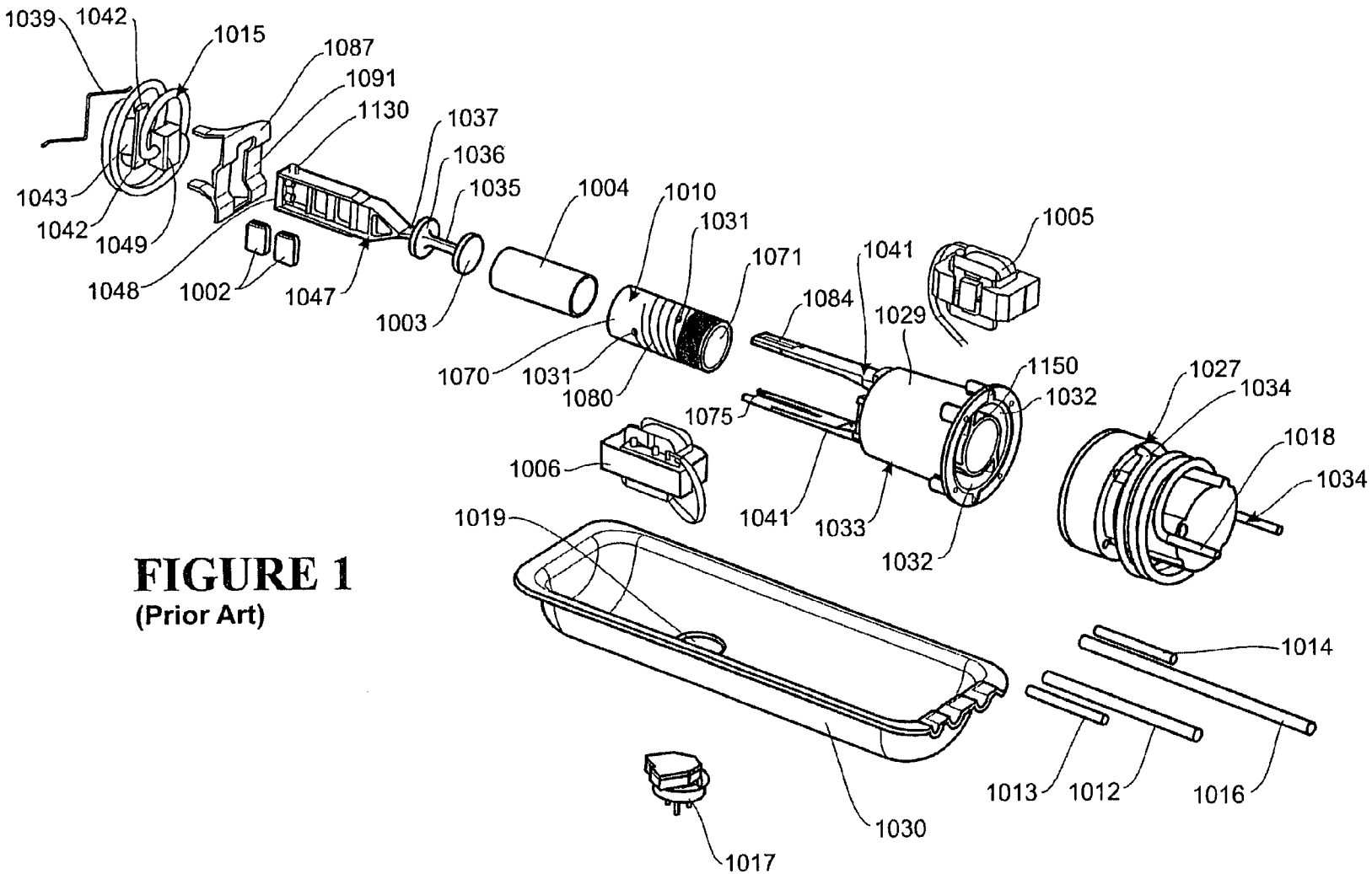
FIGURE 1 (Prior Art)
FIG. 1 is a partially exploded view from above of a prior art linear compressor according to WO 02/35093.
Figure 2:
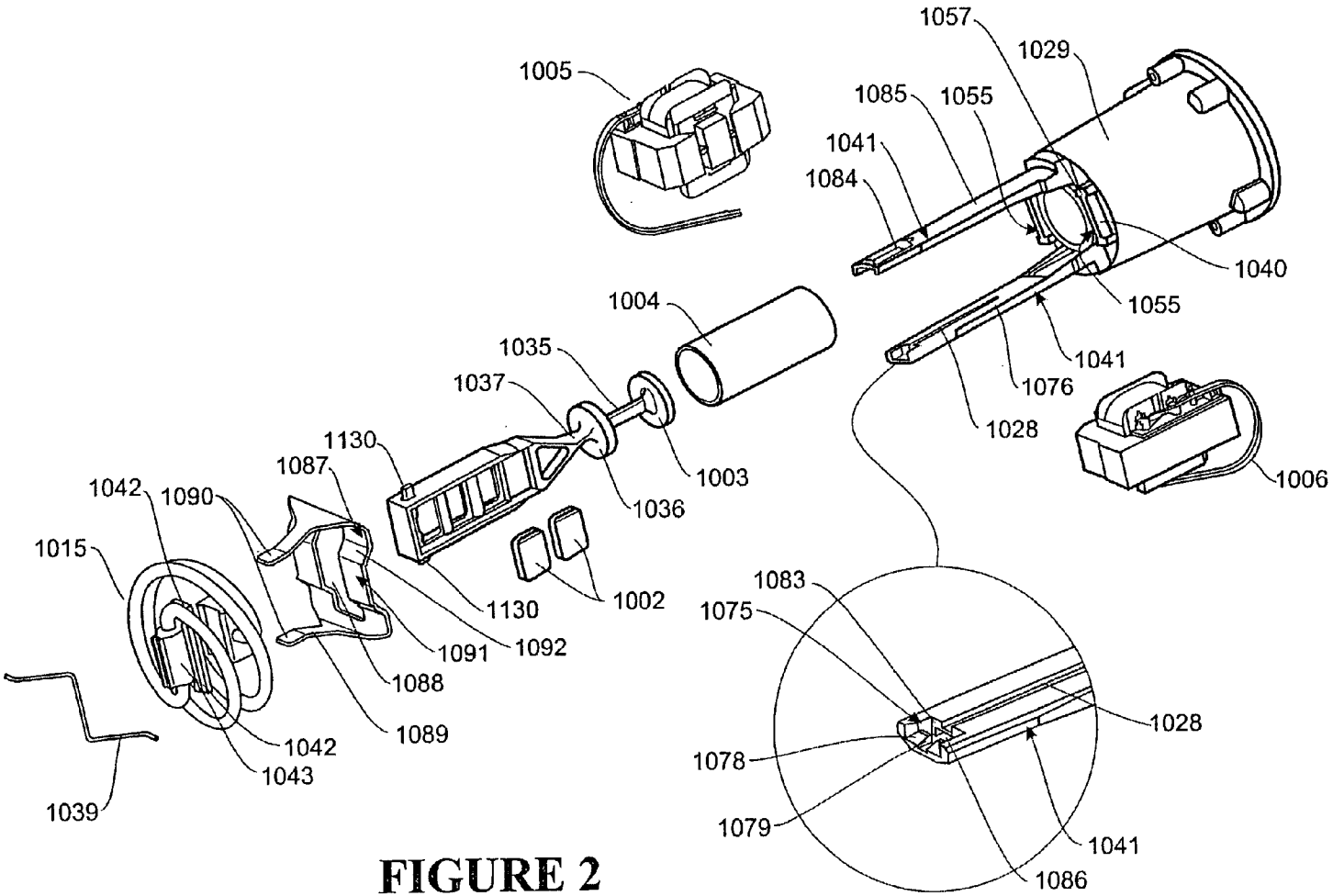
FIGURE 2 (Prior Art)
FIG. 2 is an enlarged exploded view of the compressor of FIG. 1 without the compressor head.
Figure 3:
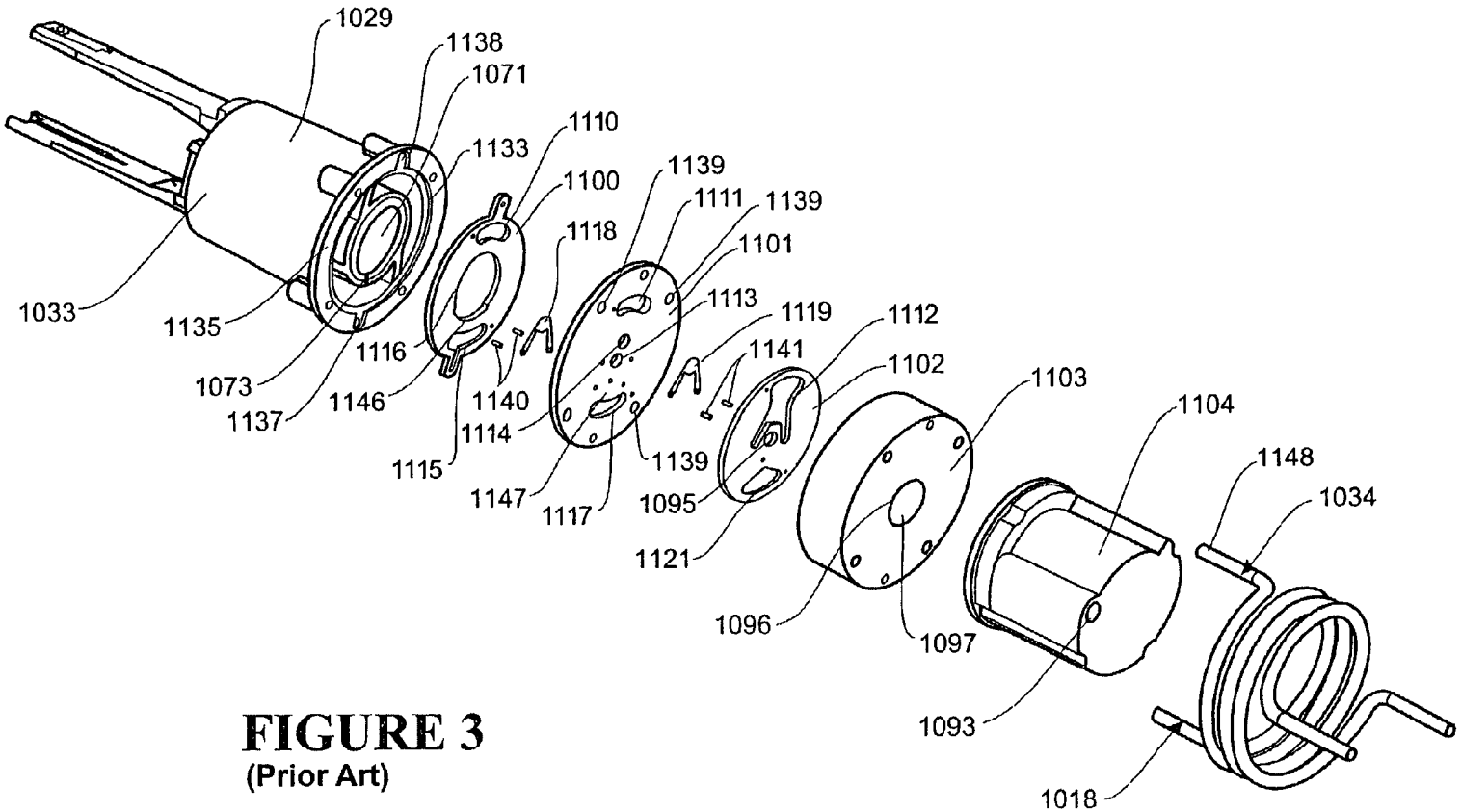
FIGURE 3 (Prior Art)
FIG. 3 is an exploded view of the compressor head of the compressor of FIG. 1.
Figure 4:
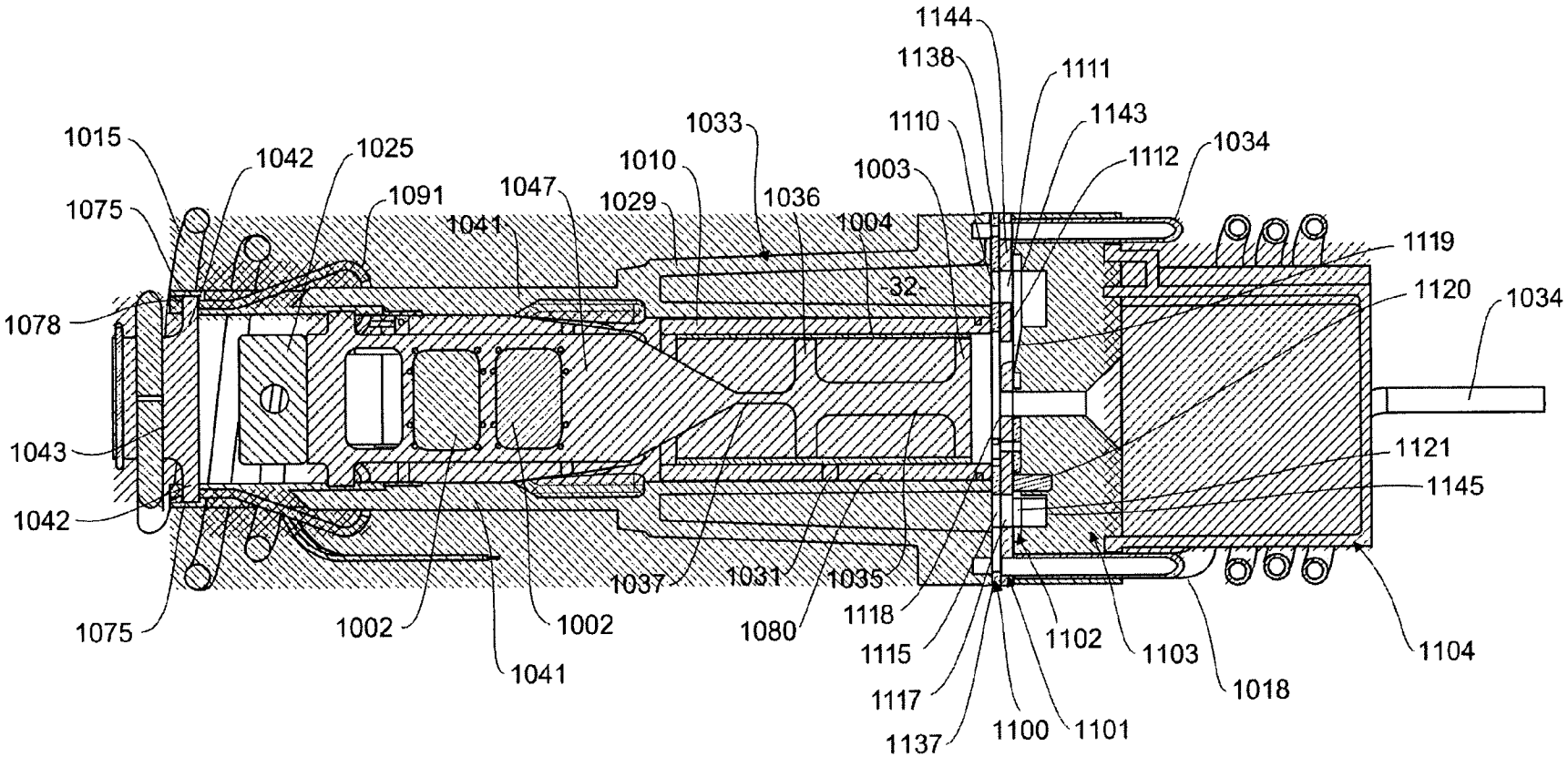
FIGURE 4 (Prior Art)
FIG. 4 is a cross sectional side elevation of the compressor of FIG. 1, excluding the hermetic housing.

Referring to FIG. 1 the compressor includes a piston 1003, 1004 reciprocating within a cylinder bore 1071 and operating on a working fluid which is alternately drawn into and expelled from a compression space at the head end of the cylinder. A cylinder head 1027 connected to the cylinder encloses an open end of the cylinder bore 1071 to form the compression space and includes inlet and outlet valves 1118, 1119 and associated manifolds. The compressed working gas exits the compression space through the outlet valve 1119 into a discharge manifold. The discharge manifold channels the compressed working fluid into a cooling jacket 1029 surrounding the cylinder 1071. A discharge tube 1018 leads from the cooling jacket 1029 and out through the hermetic casing.

The cylinder housing and jacket 1029 are integrally formed as a single entity 1033 (for example a casting). The jacket 1029 comprises one or more open ended chambers 1032 substantially aligned with the reciprocation axis of the cylinder 1071 and surrounding the cylinder 1071. The open ended chambers 1032 are substantially enclosed to form the jacket space (by the cylinder head assembly 1027).

The linear motor includes a pair of opposed stator parts 1005, 1006 which are rigidly connected to the cylinder casting 1033.

The piston 1003, 1004 reciprocating within the cylinder 1071 is connected to the cylinder assembly 1027 via a spring system. It operates at or close to its natural resonant frequency subject to the additional spring effect of the compressed gases. The primary spring element of the spring system is a main spring 1015. The piston 1003, 1004 is connected to the main spring 1015 via a piston rod 1047. The main spring 1015 is connected to a pair of legs 1041 extending from the cylinder casting 1033. The pair of legs 1041, the stator parts 1005, 1006, the cylinder moulding 1033 and the cylinder head assembly 1027 together comprise what is referred to as a cylinder part 1001 during discussion of the spring system.

The piston rod 1047 connects the piston 1003, 1004 to the main spring 1015. The piston rod 1047 is rigid. The piston rod has a plurality of permanent magnets 1002 spaced along it and forms the armature of the linear motor.

For low frictional loading between the piston 1003, 1004 and the cylinder 1071, and in particular to reduce any lateral loading, the piston rod 1047 is resiliently and flexibly connected with both the main spring 1015 and with the piston 1003, 1004. In particular a resilient connection is provided between the main spring end 1048 of the piston rod 1047 in the form of a fused plastic connection between an over moulded button 1049 on the main spring 1015 and the piston rod 1047. At its other end the piston rod 1047 includes a pair of spaced apart circular flanges 1003, 1036 which fit within a piston sleeve 1004 to form the piston. The flanges 1003, 1036 are in series with and interleaved with a pair of hinging regions 1035, 1037 of the piston rod 1047. The pair of hinging regions 1035, 1037 are formed to have a principle axis of bending at right angles to one another.

At the main spring end 1048 the piston rod 1047 is radially supported by its connection to the main spring 1015. The main spring 1015 is configured such that it provides for a reciprocating motion but substantially resists any lateral motion or motion transverse to the direction of reciprocation of the piston within the cylinder.

The assembly which comprises the cylinder part is not rigidly mounted within the hermetic casing. It is free to move in the reciprocating direction of the piston, apart from supporting connections to the casing: the discharge tube 1018, a liquid refrigerant injection line 1034 and a rear supporting spring 1039. Each of the discharge tube 1018 and the liquid refrigerant injection line 1034 and the rear supporting spring 1039 are formed to be a spring of known characteristic in the direction of reciprocation of the piston within the cylinder. For example the tubes 1018 and 1034 may be formed into a spiral or helical spring adjacent their ends which lead through the hermetic casing 1030.

The total reciprocating movement is the sum of the movement of the piston 1003, 1004 and the cylinder part.

The piston 1003, 1004 is supported radially within the cylinder by aerostatic gas bearings. The cylinder part of the compressor includes the cylinder casting 1033 having a bore 1150 there through and a cylinder liner 1010 within the bore 1150. The cylinder liner 1010 may be made from a suitable material to reduce piston wear. For example it may be formed from a fibre reinforced plastic composite such as carbon fibre reinforced nylon with 15% PTFE (also preferred for the piston rod and sleeve), or may be cast iron with the self lubricating effect of its graphite flakes. The cylinder liner 1010 has openings 1031 there through, extending from the outside cylindrical surface 1070 thereof to the internal bore 1071 thereof. The piston 1003, 1004 travels in the internal bore 1071, and these openings 1031 form the gas bearings. A supply of compressed gas is supplied to the openings 1031 by a series of gas bearing passages. The gas bearing passages open at their other ends to a gas bearing supply manifold, which is formed as an annular chamber around the cylinder liner 1010 at the head end thereof between the liner 1010 and the cylinder bore 1071. The gas bearing supply manifold is in turn supplied by the compressed gas manifold of the compressor head by a small supply passage 1073.

The gas bearing passages are formed as grooves 1080 in the outer wall 1070 of the cylinder liner 1010. These grooves 1080 combine with the wall of the other cylinder bore 1071 to form enclosed passages leading to the openings 1031.

The gas bearing grooves 1080 follow helical paths. The lengths of the respective paths are chosen in accordance with the preferred sectional area of the passage, which can be chosen for easy manufacture (either machining or possibly by some other form such as precision moulding).

Each part 1005, 1006 of the stator carries a winding. Each part 1005, 1006 of the stator is formed with a "E" shaped lamination stack with the winding carried around the central pole. The winding is insulated from the lamination stack by a plastic bobbin.

The cylinder part 1001 incorporates the cylinder 1071 with associated cooling jacket 1029, the cylinder head 1027 and the linear motor stator parts 1005, 1006 all in rigid connection with one another. The cylinder part 1001 incorporates mounting points for the main spring 1015, the discharge tube 1018 and the liquid injection tube 1034. It also carries the mountings for cylinder part connection to the main spring 1015.

The cylinder and jacket casting 1033 has upper and lower mounting legs 1041 extending from the end away from the cylinder head. The spring 1015, the preferred form of which will be described later, includes a rigid mounting bar 1043 at one end for connection with the cylinder casting 1033. A pair of laterally extending lugs 1042 extend from the mounting bar 1043. The upper and lower mounting legs 1041 of the cylinder casting 1033 each include a mounting slot or rebate 1075 for one of the lugs 1042. Once past protrusions or barbs 1078 provided in rebate 1075, the lugs 1042 are trapped between the perpendicular faces 1079 of the barbs 1078 and the perpendicular faces 1083 forming the end face of the rebates 1075.

The internal surface 1076 of each leg 1041 has an axial slot 1028 extending from the rebate 1075. Outwardly extending lugs 1130 on the piston connecting rod 1047 reciprocate within the slots 1028 while operating.

A clamping spring 1087 has a central opening 1088 through it such that it may fit over the pair of mounting legs 1041. The clamping spring 1087 has rearwardly extending legs 1089 associated with each mounting leg 1041. The free ends 1090 of these legs 1089 slide within outer face rebates 1084 of the mounting legs 1041 and are sufficiently small to pass through axial openings 1086 between the outer and inner rebates 1084 and 1075. With the lugs 1042 of the main spring mounting bar 1043 in place in the inner rebates 1075 of the mounting legs 1041 these free ends 1090 press against the lugs 1042 and hold them against the perpendicular faces 1079 of the respective barb 1078. Retention of the clamping spring 1087 in a loaded condition supplies a predetermined preload against the lugs 1042.

The clamping spring performs the parallel task of mounting the stator parts 1005, 1006. The clamping spring 1087 includes a stator part clamping surface 1091 in each of its side regions 1092.

The cylinder casting 1033 includes a pair of protruding stator support blocks 1055.

When in position, natural attraction between the parts of the motor will draw the stator parts 1005, 1006 towards one another. The width of the air gap is maintained by the location of the perpendicular step 1057 against outer edges 1040, 1072 of the mounting blocks 1055 and clamping spring 1087 respectively. To additionally locate the stator parts 1005, 1006 in a vertical direction (the stator engaging surface) of each mounting block 1055 includes a notch 1057 in its outer edge which in a vertical direction matches the dimension of the "E" shaped lamination stack.

The stator parts 1005 and 1006 are electrically connected to power supply connector 1017. The power supply connector 1017 is fitted through an opening 1019 in the hermetic shell 1030.

The open end of cylinder casting 1033 is enclosed by the compressor head 1027. The compressor head thereby encloses the open end of cylinder 1071, and of the cooling jacket chambers 1032 surrounding the cylinder 1071. In overall form the cylinder head 1027 comprises a stack of four plates 1100 to 1103 together with a suction muffler/intake manifold 1104.

An annular rebate 1133 is provided in the face of flange 1135. Outwardly extended lobes 1137, 1138 act as ports for the discharge tube 1018 and the return tube 1034 respectively.

Openings are provided between the three chambers in the cylinder casting 1033.

First head plate 1100 fits over the open end of the cylinder moulding 1033 within the annular rebate 1133.

Second head plate 1101 fits over the first plate 1100. Second plate 1101 is of larger diameter than plate 1100 and may be made from steel, cast iron, or sintered steel. The plate 1101 is more extensive than the rebate within which plate 1100 sits. The plate 1101 resides against the face of the flange and compresses the first plate 1100 against the rebate. The plate 1101 has openings 1139 spaced around its perimeter, sized so that the threaded portion of the bolts pass through freely.

The second head plate 1101 incorporates a compressed gas discharge opening 1111 in registration with opening 1110. It also includes a further opening 1117 in registration with opening 1115 in first plate 1100.

A portion of the plate 1101 encloses the cylinder opening 1116 of plate 1100. Through that portion of plate 1101 pass an intake port 1113 and a discharge port 1114. A spring steel inlet valve 1118 is secured to a face of plate 1101 covering the intake port 1113. The base of the inlet valve 1118 is clamped between the plate 1100 and the plate 1101 and its position is secured by dowels 1140. A spring steel discharge valve 1119 is attached to the other face of plate 1101 covering the discharge opening 1114. The base of valve 1119 is clamped between the second plate 1101 and the third plate 1102 and located by dowels 1141. The discharge valve 1119 fits and operates within a discharge manifold opening 1112 of the third plate 1102 and a discharge manifold 1142 formed in the fourth plate 1103. The inlet valve 1118 sits (apart from its base) within the cylinder compression space and operates in it.

The third head plate 1102 fits within a circular rebate 1143 in the cylinder facing face 1144 of fourth plate 1103. The plate 1102 is relatively flexible and serves as a gasket and is compressed between fourth plate 1103 and second plate 1101.

A gas filter 1120 receives compressed refrigerant from rebate 1145 and delivers it to the gas bearing supply passage 1073 through holes 1146, 1147 in the first and second plates.

An intake opening 1095 through third plate 1102 is in registration with intake port 1113 in second plate 1101 and intake port 1096 passing through fourth plate 1103. A tapered or frusto-conical intake 1097 in the face 1098 of fourth plate 1103 leads to the intake port 1096. The intake port 1096 is enclosed by the intake muffler 1104. The suction muffler 1104 includes a refrigerant intake passage 1093 extending from the enclosed intake manifold space to open out in a direction away from the cylinder moulding 1033. With the compressor situated within its hermetic housing an internal projection 1109 of an intake tube 1012 extending through the hermetic housing extends into the intake passage 1093 with generous clearance.

Liquid refrigerant is supplied from the outlet of a condenser in the refrigeration system, directly into the cooling jacket chambers 1032 surrounding the cylinder. The discharged newly compressed refrigerant passes into the chambers before leaving the compressor via discharge tube 1018. In the chamber 1032 the liquid refrigerant vaporises absorbing large quantities of heat from the compressed gas and from the surrounding walls of the cylinder castings 1033 and from the cylinder head 1027.

A passive arrangement is used for bringing the liquid refrigerant into the cooling jacket. A small region of lowered pressure is produced immediately adjacent the outlet from the liquid return line 1034 into the jacket space. This region of lower pressure has already been described comes about through the flow of compressed gas into the jacket through compressed gas opening 1110 in head plate 1100. A slight inertial pumping effect is created by the reciprocating motion of the liquid refrigerant return pipe 1034 in the direction of its length.

The main spring is formed from circular section music wire which has a very high fatigue strength with no need for subsequent polishing.

The main spring takes the form of a continuous loop twisted into a double helix.

The length of wire forming the spring 1015 has its free ends fixed within a mounting bar 1043 with lugs 1042 for mounting to one of the compressor parts. The spring 1015 has a further mounting point 1062 for mounting to the piston part.

The linear compressor receives evaporated refrigerant at low pressure through suction tube 1012 and expels compressed refrigerant at high pressure through the discharge stub 1013. In the refrigeration system the discharge stub 1013 would generally be connected to a condenser. The suction tube 1012 is connected to receive evaporated refrigerant from one or more evaporators. The liquid refrigerant delivery stub 1014 receives condensed refrigerant from the condenser (or from an accumulator or the refrigerant line after the condenser) for use in cooling the compressor as has already been described. A process tube 1016 extending through the hermetic casing is also included for use in evacuating the refrigeration system and charging with the chosen refrigerant.

DETAILED DESCRIPTION OF THE INVENTIONS HEREIN

Gas bearings use some of the high-pressure gas that the linear compressor produces. Consequently it is beneficial to minimise the flow to the bearings. However the force generated by a bearing port is roughly proportional to the amount of gas flowing through it. The port force is also affected by the down stream pressure, which varies significantly near the head end of a linear compressor.

A further property of gas bearings is that they have a relatively slow response time, so that it may take 1 or 2 seconds to adjust to a variation of applied force. This is equivalent to 50 to 200 strokes of the compressor, so that there is potential to have piston/cylinder contact at times, particularly at the beginning of the suction stroke.

According to one invention herein these problems are addressed by incorporating a hydrodynamic (slipper) bearing that converts the movement of the piston into a bearing force. This form of bearing has a fast response and can provide a force that will augment the gas bearing force.

Figure 5A:
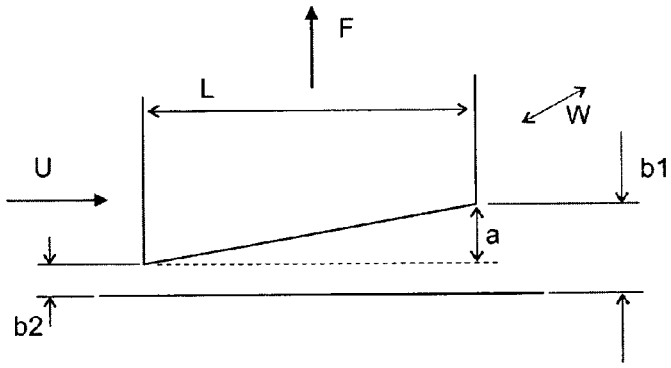
FIG. 5A is a diagram illustrating various parameters associated with a hydrodynamic bearing adopted according to one invention herein.

A 2-dimensional slipper bearing is shown in FIG. 5A where the wedge of fluid generates a bearing force F at right angles to the velocity U. This force can be approximated from the formulae $$Pt = 6\cdot\mu\cdot U\cdot\frac{L}{(b_1-b_2)^2}\cdot\left[\ln\left(\frac{b_1}{b_2}\right)-2\cdot\left(\frac{b_1-b_2}{b_1+b_2}\right)\right] \quad (1)$$

$$F = Pt\cdot w\cdot L \quad (2)$$

where Pt is the transverse pressure generated by the slipper bearing, μ is the viscosity of the fluid, U is the velocity of the moving part, L is the length of the taper, $b_1$ is the clearance at the leading end of the taper, $b_2$ is the clearance at the trailing end of the taper and w is the width of the bearing (i.e. in a direction perpendicular to the plane of FIG. 5A).

Figure 5B:
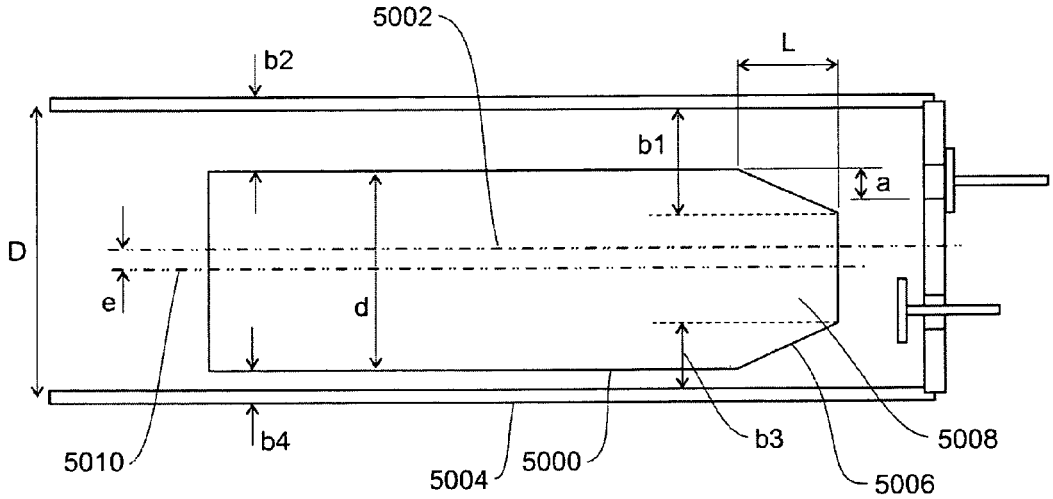
FIG. 5B is a diagrammatic cross sectional side elevation of a piston and cylinder wall, with the piston profile modified according to one invention herein.

In the preferred embodiment of the present invention the wedge shape is formed by tapering the end 5008 of the piston 5000, as illustrated in FIG. 5B. Then the force on one side is balanced by the force on the opposite side, unless the piston is offset (by a distance e) from the centreline 5002 of the cylinder 5004. With the offset, the centering force Fp, generated by the bearing 5006 is found from the approximate formulae $$b_1 = \frac{D-d}{2}+a+e \quad (3)$$

$$b_2 = \frac{D-d}{2}+e \quad (4)$$

$$b_3 = \frac{D-d}{2}+a-e \quad (5)$$

$$b_4 = \frac{D-d}{2}-e \quad (6)$$

$$Pt = 6\cdot\mu\cdot U\cdot\frac{L}{(b_1-b_2)^2}\cdot\left[\ln\left(\frac{b_1}{b_2}\right)-2\cdot\left(\frac{b_1-b_2}{b_1+b_2}\right)\right] \quad (7)$$

$$Pb = 6\cdot\mu\cdot U\cdot\frac{L}{(b_3-b_4)^2}\cdot\left[\ln\left(\frac{b_3}{b_4}\right)-2\cdot\left(\frac{b_3-b_4}{b_3+b_4}\right)\right] \quad (8)$$

$$Fp = 0.7\cdot D\cdot(Pb-Pt)\cdot L$$

where: $b_1$ is the clearance at the leading edge of bearing 5006 at the side of greater clearance due to the offset; $b_2$ is the normal piston to cylinder wall clearance at the same side as $b_1$; $b_3$ is the clearance at the leading edge of 5006 at the side having lowest clearance due to the offset; $b_4$ is the normal piston to cylinder wall clearance in the same side as $b_3$; D is the cylinder diameter; d is the standard piston diameter; e is the offset of the piston axis 5010 from the cylinder axis 5002; Pt is the pressure generated by the bearing at the increased clearance side; Pb is the pressure generated at the decreased clearance side; μ is the viscosity of the fluid; U is the movement velocity of the piston relative to the cylinder; L is the axial length of the bearing; and a is the radial depth of the taper or step.

This method works particularly well at the head end of the piston where the gas bearings are less effective due to the reduced pressure difference during the compression stroke.

The step or taper can stop "within cycle" piston/cylinder contact during start up when the gas bearings do not yet have sufficient supply to operate effectively. The lift force from the bearing is generated as soon as the piston moves.

From equation (1) it can be derived that the optimum force from a slipper bearing occurs when the wedge height a is equal to the clearance $b_1$. A linear refrigeration compressor of the type described herein performs best with radial clearances of between 3 and 8 micron, so the relation above implies a taper of about 5 micron. The figures are not to scale and the relative size of the step or taper and of the clearance are greatly exaggerated.

A taper of this depth is difficult to machine concentrically with the piston axis using conventional machinery. Machining is easier if the taper is converted into a step (eg: 6002 in FIG. 6). The slipper bearing effect is still apparent if the taper is converted into a step.

Figure 6:
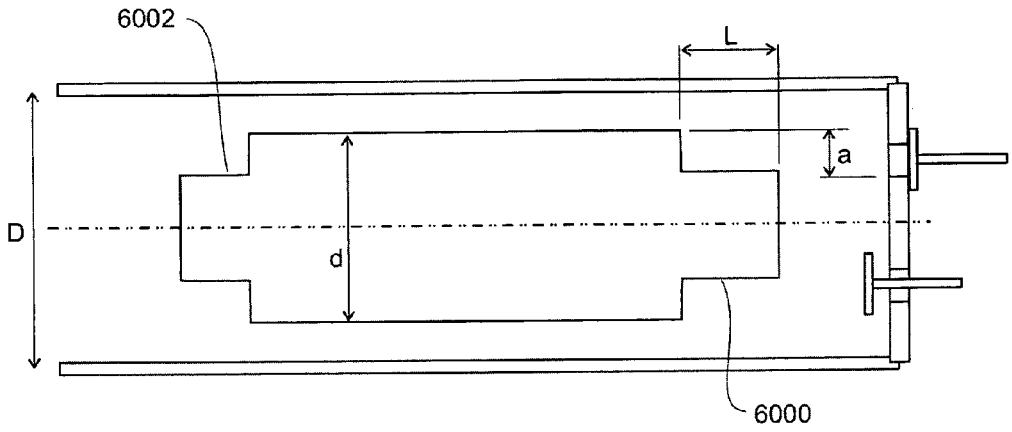
FIG. 6 is a diagrammatic cross sectional side elevation of a piston and cylinder wall with piston profile modified according to an alternative embodiment of the invention of FIG. 5B.

Also as indicated in FIG. 6 a taper or step 6002 may be provided at the rear end of the piston in addition to or instead of at the head end of the piston. It is considered that this would not be quite so effective as the bearing at the head end of the piston due to the difference in the prevailing pressures at these locations. However as a taper at the tail end of the piston does not affect the compression volume or operation of the gas bearings any positive gain from the generated lift may be of benefit.

It has been found that if the step is formed by chemical machining the step surface remains concentric with the rest of the piston. Chemical machining involves immersing the piston end in an electrolyte to slowly erode away the piston surface. The erosion can be accomplished by providing the electrolyte as an acid, for example highly concentrated HCl, or by electrochemical erosion. In the case of electrochemical erosion it is important that the erosive action occurs uniformly around the piston. This may be facilitated by providing a circular or annular anode coaxial with the piston with the piston end immersed in the electrolyte.

Figure 7:
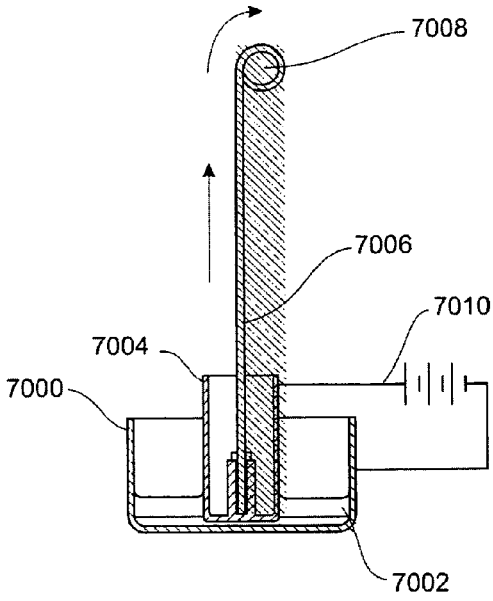
FIG. 7 is a cross section through a chemical machining bath illustrating a method of forming a preferred embodiment of the invention of FIG. 5B.

Referring to FIG. 7 one possible embodiment is illustrated in which piston 7004 is lowered into a pool of electrolyte 7002. The pool of electrolyte is contained in a bath 7000. An electrical potential 7010 is applied between the piston 7004 and the bath 7000. The piston 7004 is thus rendered a cathode and the bath 7000 is rendered an anode and the surface of the piston is slowly eroded.

In one preferred embodiment of this invention the piston outer surface is provided with a hard chrome plating. The chemical machining occurs wholly within the coated or plated layer. For example the plating or coating layer could be made in the order of 50 μm thickness, while the maximum depth of corrosion would be approximately 5 μm.

In our preferred embodiment, with a piston diameter of approximately 25 mm and a piston length of approximately 50 mm we propose a 10 mm long step on the cylindrical surface of the piston at the head end of the piston. A step could be provided at the other end as well as illustrated as step 6002 in FIG. 6.

According to a further aspect of this invention it is possible to use chemical machining to produce a graduated taper. In particular, with reference to FIG. 7, the end of piston 7004 is immersed in the electrolyte to a depth corresponding with the length of the taper intended to be produced. The piston is supported to be slowly retractable from the bath. For example a wire 7006 may wind onto a slowly rotating spindle 7008 to raise the piston from the bath. The piston is gradually withdrawn so that the length of time immersed in the solution varies (preferably linearly) with the position along the taper, the piston end of the taper being immersed for a time to create the full taper depth, while the distal end of the taper is immersed only briefly. The immersion regime can be subject to substantial variation. For example the piston end can be gradually inserted or can be slowly reciprocated in the electrolyte.

As already described, our preferred compressor arrangement has the magnets on the connecting rod between the spring and the piston. To make this work most effectively we have found that the rod should be rigid and should be compliantly mounted at one or both ends in such a way that it is able to rotate to form an angle with the line of axial travel so that the piston can be axially aligned irrespective of misalignment of the piston rod. This would seem also an advantage in compressors which do not have the armature on the piston rod.

A further invention herein is a piston to piston rod connection wherein the loads applied to the piston are arranged so that lateral loads are applied at a position away from the piston ends. Axial loads are transmitted directly to the piston crown. The connection allows rotational flexibility between the piston and the piston rod, transverse to and uniformly around the piston reciprocation axis. This has the advantage of not encouraging tilting of the piston in the cylinder, allowing gas bearings or other lubrication to work more effectively.

Figure 8:
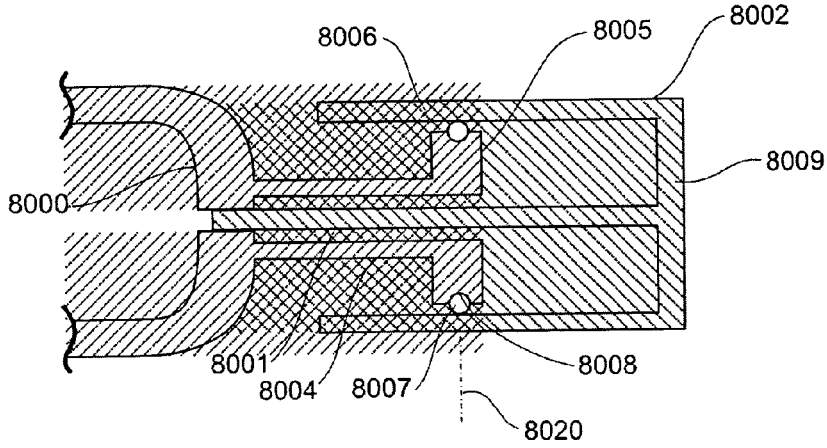
FIG. 8 is a side elevation in cross section of a compliant connection between a piston and piston rod according to one embodiment of another invention herein including a disc and O-ring bearing on the piston sleeve.

FIG. 8 illustrates one arrangement for providing a compliant connection between the piston rod and the piston which will apply lateral loads at a position away from the end of the piston.

The piston 8002 has a cylindrical wall 8006 and is enclosed by a crown 8009 at one end. A compliant rod 8001 is fixed at one end to the crown 8009 of piston 8002. The compliant rod 8001 is fixed at its other end to a piston rod 8000. The compliant rod is axially stiff but laterally compliant. It may for example be a narrow gauge length of high strength steel music wire. A support 8004 extends from a leading face of the piston rod 8000. The support 8004 preferably takes the form of a cylindrical up stand. A disc 8005 extends from the open end of the cylindrical up stand 8004 as an annular flange. The disc 8005 extends to be adjacent the inner surface of the cylindrical wall 8006 of the piston. A bearing is provided between the outer edge of the disc 8005 and the inner surface of cylindrical wall 8006. The bearing must transmit lateral forces while accommodating the slight variation in orientation that will occur between the piston 8002 and piston rod 8000. In the preferred form the bearing includes a bearing material interposed between the inner surface of the cylindrical sidewall 8006 and the outer edge of disc 8005. Preferably this is in the form of an O-ring 8007 disposed in an outwardly facing annular channel 8008 of the disc 8005. The O-ring may comprise an elastomeric material, for example 90A shore hardness nitrile rubber, or a dry bearing material, such as unfilled PTFE polymer. The elastomeric material would accommodate the slight relative movement through flexing of the O-ring material. The dry bearing material would accommodate relative movement by low friction sliding action between the surface of the dry bearing material and the inside surface of the piston sidewall 8006. The elastomeric material has the benefit of coping with slight variations in fit more readily than the rigid dry bearing material. However the dry bearing material provides a more rigid load transfer to the piston.

Figure 12:
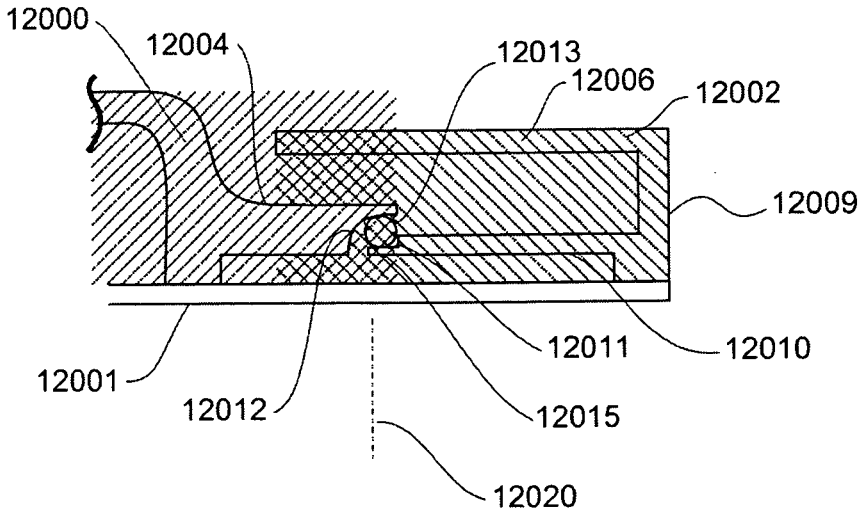
FIG. 12 is a side elevation in cross section of a compliant connection between a piston and piston rod according to one embodiment of an invention herein including an O-ring bearing on a cantilever extension from the piston crown.

FIG. 12 illustrates an arrangement for providing a compliant connection between the piston rod and the piston which will apply lateral loads at a load line 12020 away from the end of the piston, the arrangement including an O-ring bearing on cantilever from crown.

In FIG. 12 the piston 12002 has a cylindrical wall 12006 and is enclosed by crown 12009 at one end. A compliant rod 12001 is fixed at one end to the crown 12009. The compliant rod 12001 is fixed at its other end to the piston rod 12000. A support 12004 extends from the leading end of the piston rod 12000. The support 12004 may take the form of a cylindrical upstand. A cantilever 12010 extends from the inner face of piston crown 12009. The cantilever 12010 may take the form of a cylindrical upstand. The distal end 12015 of cantilever 12010 is flexibly coupled with end 12012 of support 12004. The flexible coupling is configured to transmit lateral forces to the end 12015 of the cantilever 12010 but to allow changes in the relative alignment of the piston and piston rod. The preferred arrangement includes an O-ring 12013 located in an outward annular groove 12011 of the cantilever 12010. The O-ring 12013 bears against an inwardly facing surface of the end 12012 of support member 12004. The O-ring is preferably formed of a comparatively soft resilient material, such as nitrile rubber or fluoro elastomer such as Viton™ A or Viton™ B, available from Du Pont. The inwardly facing surface preferably has substantially spherical form with a diameter matching the outside diameter of the O-ring. Further variations on this embodiment include reversing the joint arrangement to have the end of the cantilever surrounding the end of the support.

Figure 9:
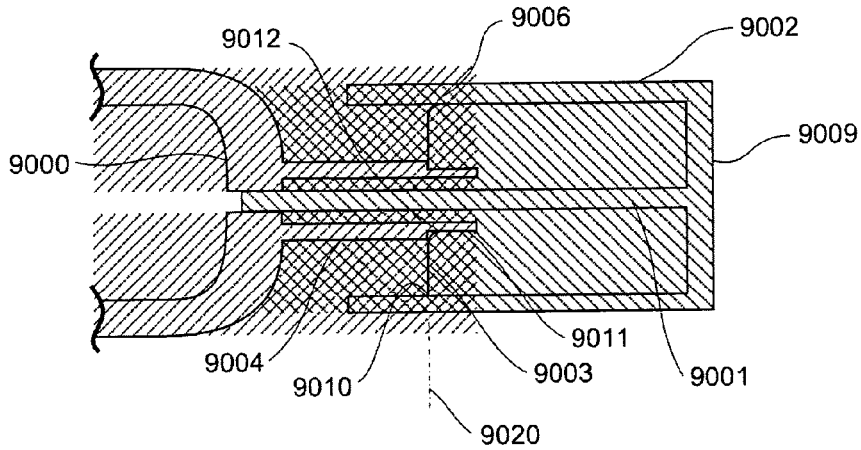
FIG. 9 is a side elevation in cross section of a compliant connection between a piston and piston rod according to one embodiment of an invention herein including a membrane extending between the inner face of the piston sleeve and the connecting rod.

FIG. 9 illustrates another arrangement for providing a compliant connection between the piston rod and the piston which will apply lateral loads at a load line 9020 away from the end of the piston. The arrangement includes a membrane extending between the inner face of the piston sleeve and the connecting rod or a sleeve surrounding the connecting rod.

The arrangement of FIG. 9 is a further variation on the arrangement of FIG. 8. The piston 9002 has a cylindrical wall 9006 and is enclosed by crown 9009 at one end. Compliant rod 9001 is fixed at one end to the crown 9009 and at its other end to the piston rod 9000. Support 9004 extends from the leading end of the piston rod 9000. The support 9004 preferably takes the form of a cylindrical upstand. A thin membrane 9003 extends from the outer surface 9012 of the support 9004 to the inner surface 9010 of cylindrical wall 9006. The membrane is preferably a thin metal disc with an aperture through its centre. The support 9004 penetrates through the aperture at the centre of the disc. The outer edge of the disc is connected to the inner surface 9010 of the cylindrical wall. Preferably the disc includes an inner annular engagement with the support 9004 and an outer annular engagement with the inner surface of the wall 9006. Preferably each engagement is tightly fitted to its respective surface. The membrane effectively transmits lateral loads to the cylindrical wall 8006 at load line 9020. Transmission is via a combination of compression through the disc on one side and tension through the disc on the other, with the tension taking over if the membrane exhibits any buckling tendency on the compression side. Yet the thinness of the membrane allows out-of-plane deformation and therefore allows changes in the relative bearing of the piston and piston rod.

Figure 10:
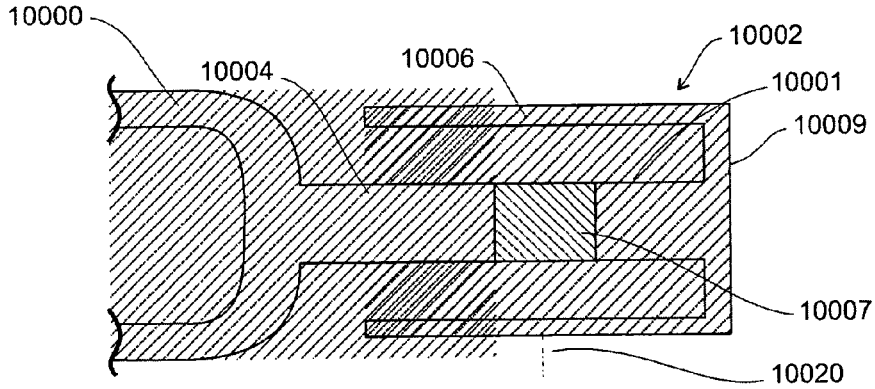
FIG. 10 is a side elevation in cross section of a compliant connection between a piston and piston rod according to one embodiment of an invention herein including a flexible joint.

FIG. 10 illustrates an arrangement for providing a compliant connection between the piston rod and the piston which will apply lateral loads at a load line 10020 away from the end of the piston. The arrangement includes an "ankle" joint.

In the arrangement in FIG. 10 the piston 1020 has cylindrical wall 10006 and is enclosed by a crown 10009. A cantilever 10001 extends from the inner face of the crown 10009. A support 10004 extends from the leading end of piston rod 10000. An elastomer block 10007 is connected to the cantilever 10001 and the support 10004. The elastomer 10007 is preferably connected to each of the cantilever and support by adhesive bonding. Defamation of the elastomer block allows for changes in the relative bearing of the piston and piston rod. However as it also reduces the axial stiffness of the connection between the piston and the piston rod it is less preferred than the other embodiments described herein. The elastomer block may for example be a fluoro elastomer such as Viton™ A or Viton™ B available from Du Pont. As an alternative to the elastomer block another elastic connection may be continued between the cantilever and the support. For example a short length of small diameter spring steel wire may be fixed at either end to the respective parts. The wire may be fixed, for example, by bonding into shallow holes in the parts or by moulding one or other part over the end of the wire.

Figure 11:
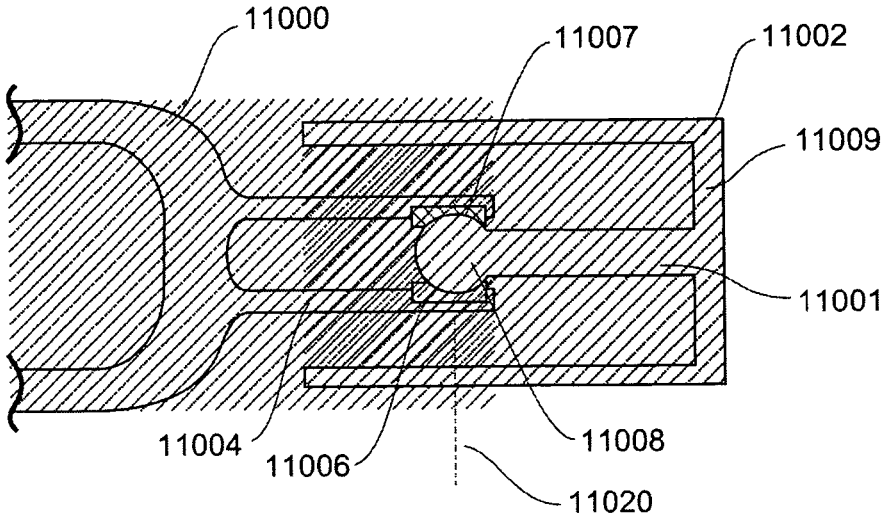
FIG. 11 is a side elevation in cross section of a compliant connection between a piston and piston rod according to one embodiment of an invention herein including a ball joint.

FIG. 11 illustrates an arrangement for providing a compliant connection between the piston rod and the piston which will apply lateral loads at a load line 11020 away from the end of the piston. The arrangement includes a "hip" joint.

In the arrangement of FIG. 11 the piston 11002 has a cylindrical wall enclosed by a crown 11009. A cantilever 11001 extends from the inner face of crown 11009. A support 11004 extends from the leading end of piston rod 11000. A ball and socket joint is provided between the cantilever 11001 and the support 11004. The ball and socket connection allows for changes in the relative bearing of the piston and piston rod. Lateral loads applied through the ball and socket joint have an effective load line 11020 on the piston 11002 at a longitudinal position matching the centre of the ball joint. In the illustrated embodiment ball 11008 is provided at the end of cantilever 11001. A corresponding socket is provided at the end of support 11004. The socket 11007 is preferably provided in a bushing 11006 of appropriate low friction bearing material such as PTFE.

There are advantages of locating the suction valve on the end of the piston in linear compressors. This can be achieved as the piston is generally hollow without being interrupted by a gudgeon pin. As discussed previously a number of prior art linear compressor designs have included a suction valve through the piston.

When a conventional suction valve starts to open the only force on it is that due to the pressure difference across the valve. This force (less than 10 kPa) accelerates the valve according to Newton's Law. This acceleration force is eventually balanced by the, usually linear, increase in spring force with valve displacement, so the valve stays open until flow through the valve stops and the pressure difference drops to zero. The valve then accelerates towards its seat due to the spring force.

When the suction valve is on the face of the moving piston, the above analysis becomes more complex as there is now an accelerating "frame of reference". This means that the force due to the pressure difference is assisted, or opposed, by the inertial force on the valve from the piston's acceleration.

In a linear compressor operating at less than maximum capacity, the suction valve both opens and closes when the inertial force opposes the pressure difference force. (This occurs because there is significant clearance volume at Top Dead Centre, and it takes considerable piston movement away from TDC before the high pressure gas trapped in the clearance volume reaches the suction gas pressure. This movement takes the piston to a position where it is starting to decelerate prior to stopping and reversing direction at Bottom Dead Centre). Thus for all of the valve open time the inertial force is restricting the amount the valve opens.

According to one invention herein the piston has a plurality of inlet ports through the crown.

Figure 15:
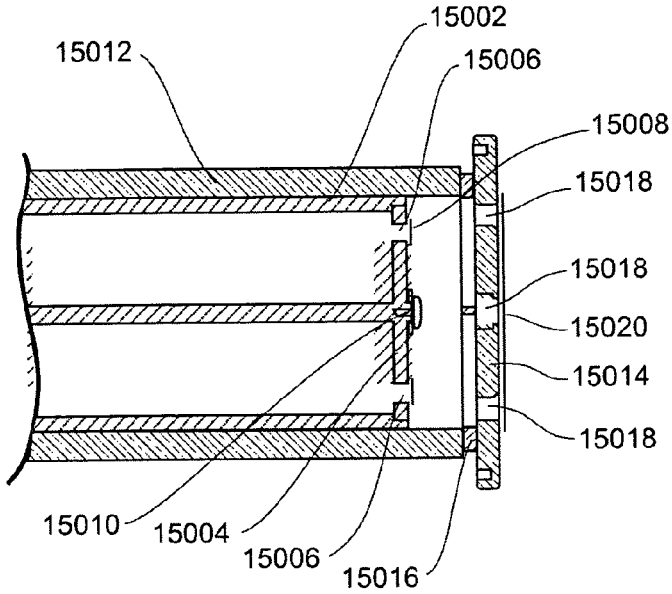
FIG. 15 is a side elevation in cross section of the crown end of a piston and of the head end of a cylinder including an enclosing valve plate each according to preferred embodiments of further inventions herein.
Figure 16:
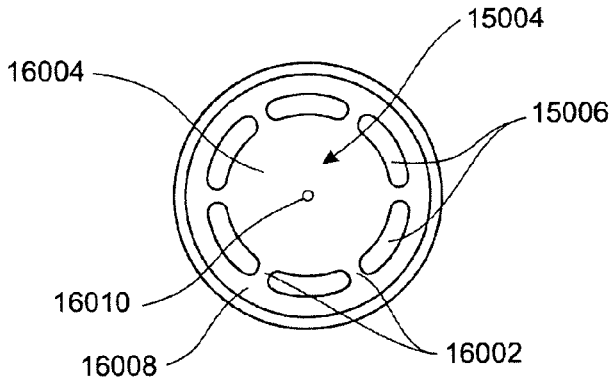
FIG. 16 is a view of the face of a piston according to a further invention herein.

Referring to FIG. 15 a preferred embodiment of this invention is illustrated in which the piston includes a piston sleeve 15002 and a piston crown 15004. The piston crown 15004 may be integral with the piston (for example the sleeve and crown may be machined from a solid billet, or from a casting) or the piston crown may be formed separate from the sleeve and welded or bonded into place. For example the crown may be machined from billet and the sleeve cut from seamless steel tube with the two components subsequently fused together. The piston crown includes a plurality of inlet ports 15006. As best seen in FIG. 16 the plurality of inlet ports 15006 are distributed in an annular array near the circumference of the piston crown. A series of spokes 16002 separate the ports 15006 and connect a hub 16004 of the crown to a circumference 16008 of the crown. While this is the preferred embodiment it could be subjected to significant variation in the arrangement of its manufacture. For example the spokes could connect directly to the piston sleeve. Preferably a singular planar valve member is provided to cover all of the ports 15006. The singular planar valve member may be in accordance with one of the embodiments described further on in relation to further inventions herein. The planar valve member 15008 may be secured centrally to the hub portion 16004 of the piston crown. For example a rivet 15010 may secure through the planar valve member 15008 and a central aperture 16010 of the piston crown. The hub of the valve member may be connected tightly to the crown or may have a connection allowing the hub to move toward and away from the crown.

The plurality of inlet ports provide a great increase in the port opening area compared to arrangements that the applicant is aware of in prior art compressors of like capacity (less than 15 cc). The inventors consider that increasing the valve opening areas beyond those formerly thought sufficient to provide essentially free flow, in fact provides a significant improvement in performance. They consider this is due to the quite different motion that prevails in the free piston linear compressor than the near simple harmonic motion that prevails in the crank driven compressor.

According to another invention herein we recognise that in such arrangements with inlet ports through the piston the head is free of the need to route suction gas through the cylinder head. In this invention the head valve plate has a plurality of discharge ports utilising the space not required for an inlet valve and manifold.

Referring to FIG. 15, the cylinder is preferably defined by a cylindrical wall 15012 closed at one end by a valve plate 15014. A gasket 15016 is interposed between the valve plate 15014 and the end of cylinder wall 15012. As discussed further, on the gasket 15016 is preferably a substantial thermal insulator. According to the preferred embodiment of the presently discussed invention the valve plate 15014 includes a plurality of discharge ports 15018. Preferably a considerable number of discharge ports are provided and in the preferred embodiment at least four and preferably six or seven ports are provided. Valves are provided to close the discharge ports 15018. Preferably the valves comprise cantilever flat spring valves, and most preferably are part of a single planar valve member 15020. Preferred forms of planar valve are discussed below in relation to other inventions. The planar valve member may be secured centrally to the valve plate 15014.

According to another invention herein the closing instant of each discharge valve is made different by slightly altering the natural frequency of each valve in the multiple valve arrangement. This smoothes the discharge pulse and leads to less noise since the closing times are not simultaneous. Changing the natural frequency of each valve may be achieved in a number of ways which may depend on the construction of the valve. For a cantilever leaf spring valve the natural frequency will depend on the mass and stiffness distributions, the manner in which the valve is fixed to the valve plate and the existence or form of any valve stop provided behind the valve. In a truly planar valve the natural frequency may be made different by selecting varied head sizes for the valves, with larger head sizes indicating a higher mass and slower response. Alternatively, or in addition, the width of the spring portion of the valve may be varied amongst the valves, with a narrower spring portion indicating a lower stiffness and slower response. Alternatively, or in addition, the planar valve member may be clamped to the valve plate in a way that the cantilever length of the valves vary, with a shorter length providing a faster response. Mass and stiffness can also be affected by other alterations, for example material cutout or material addition. Furthermore a valve backstop may be provided shaped to alter the effective valve stiffness of each valve as the valve opens. For example the backstop may provide early stopping contact against a basal region of the valve spring portion, thereby shortening the spring portion as the valve opens. This, alone or in combination with other aspects of the valve design may be applied to give each valve a slightly different closing response.

Figure 17:
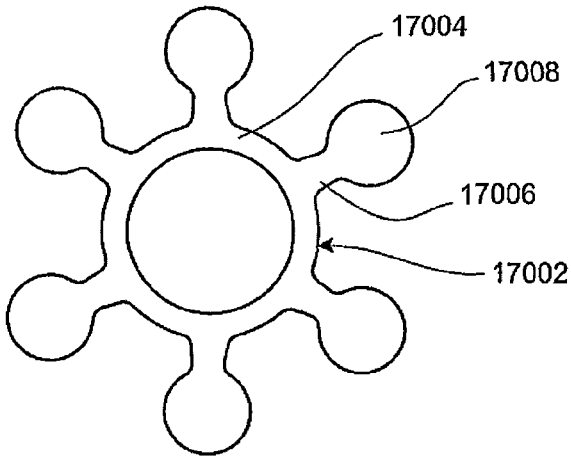
FIG. 17 is a plan view multi valve planar valve member according to one embodiment of a further invention herein.

Referring to FIG. 17 a six port planar discharge valve 17002 is depicted which includes an annular hub 17004 and six radial spring portions 17006 extending from the hub 17004. A valve head 17008 extends from a distal end of each spring portion 17006. If all of the valves of this valve member enjoy uniform operating conditions (seat, clamping and backstop) then the valves will close simultaneously. However the response can be altered by varying the valve seating, valve clamping or backstop.

Figure 20:
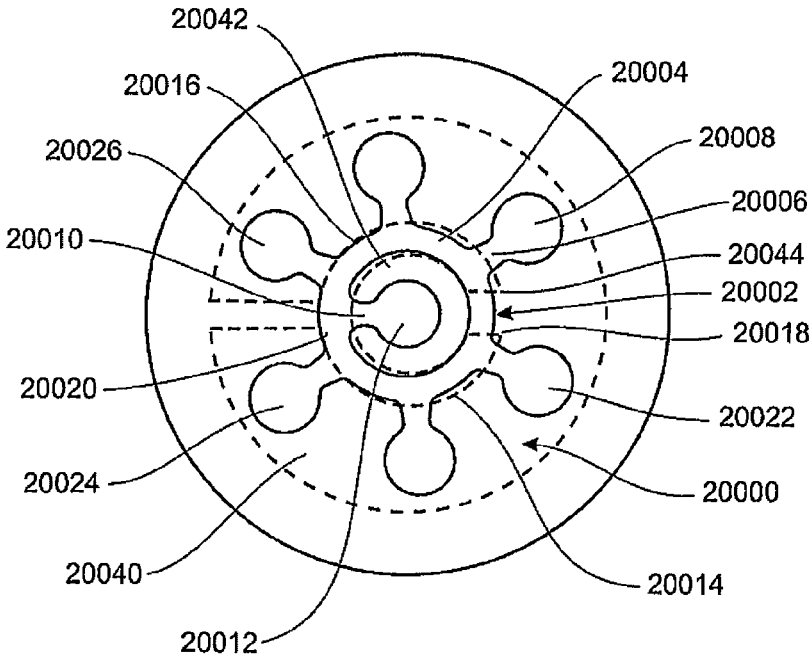
FIG. 20 is a view of a valve plate including multiple discharge ports and a multi valve planar valve member according to another embodiment of inventions herein.

An example of a valve like that of FIG. 17 providing varied valve response is depicted in FIG. 20. The valve member 20002 includes an annular hub 20004 with a plurality of valves extending radially outward and an additional valve centred within the annulus. An array of spring portions 20006 extends outward from annular hub 20004, each with a valve head 20008 at its distal end. A spring portion 20010 extends inward from the annular hub 20004 and has a further valve head 20012 at its distal end. The planar valve member is shown as placed on a valve plate. The dashed line represents the footprint of a discharge head which clamps the valve member to the valve plate and provides both varied valve closing time and varied discharge path length (in accordance with another invention herein as described below). The footprint of the discharge head includes curved walls 20014 and 20016 which clamp the valve member 20002 against the valve plate 20000. With the valve member clamped in place the distance of each valve head 20008 from the outer each of walls 20014 and 20016 are not all the same. In particular, referring to wall 20014, the outer edge of wall 20014 adjacent end 20018 is relatively further out than the outer edge of the wall at end 20020. Accordingly the effective length of the spring portion for valve 20022 is shorter than the effective length of the spring portion of valve 20024. The response of valve 20022 is therefore faster than the response of valve 20024. In the embodiment depicted the seven valves may have closing times that are not each different from all the others. For example the clamping of valves 20024 and 20026 is substantially the same and the expected response of these valves will be substantially the same. It is possible to configure the clamping footprint of the discharge head to provide complete variation of response amongst the valves where that is preferred.

Figure 18:
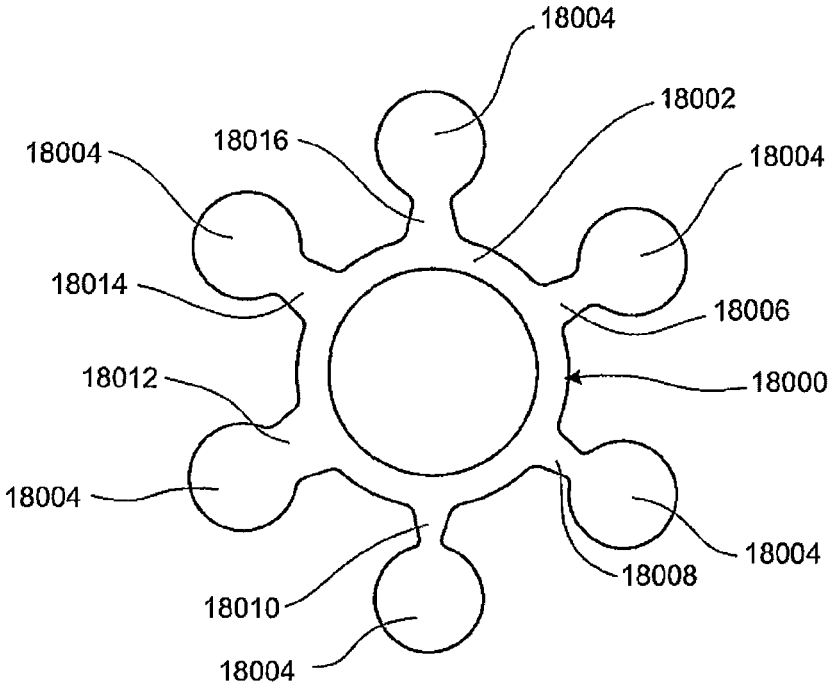
FIG. 18 is a plan view of a multi valve planar valve member according to one embodiment of a further invention herein.

Referring to FIG. 18 a planar valve member is depicted in which valve response varies in accordance with the stiffness of the spring portion of each valve. The planar valve member 18000 includes an annular hub 18002 for clamping to the valve plate. Valve heads 18004 are displaced radially outward from the annular hub 18002. Each valve head 18004 is joined with the hub 18002 by a spring portion. The widths of each spring portion are not all the same. In the embodiment illustrated each spring portion has a similar profile but is of different width. For example the width of spring portion 18010 is less than the width of spring portion 18008, which is less than the width of spring portion 18006, which is less than the width of spring portion 18016 is less than the width of spring portion 18012. This corresponds with an increasing stiffness and faster response moving through that series. Increasing stiffness does not need to follow in a sequence around the valve.

A valve where the varied response is non-sequential around the valve member is illustrated in FIG. 22. The valve member of FIG. 22 illustrates a form in which the response is varied with the size of the valves. Valve member 22002 includes an annular hub 22004, a plurality of outwardly extending spring portions 22006 of substantially uniform profile. Valve heads 22008 to 22013 are formed at the distal end of each spring portion 22006. The valve heads 22008 to 22013 are numbered in accordance with increase in size and accordingly with slower response. The response of a valve will be slower than the response of the valves with smaller valve heads. The valve 22002 also includes a central valve 22014 illustrating the desirability of utilising as much of the head space as possible for the discharge opening.

The valve of FIG. 22 also embodies another invention herein. The varying head size varies the opening response as well as the closing response. The inventors consider that the opening response is influenced by the mass of the valve, and accordingly the varied mass leads to varying opening speeds. Although the valves will start to open simultaneously, the degree of opening of the larger valves will be initially lower than for the smaller valves. Staggered valve opening can also be achieved by clamping the valve to a valve plate where the discharge ports are not all provided at a uniform level (relative to the plane of the valve member). With the valve member clamped against the valve plate the spring portions of at least some of the valves will be pre-stressed when closed. Staggering valve opening should also smooth the pressure pulsation in the discharge head.

According to a further invention herein different path lengths are provided to the discharge port to smooth the discharge pulse.

The discharge pathways are arranged so that there is a different length between each discharge port and the outlet point of the discharge head. This is illustrated in the example head shown in FIGS. 19A and 19B and also in the heads of FIGS. 20 and 36.

Figure 19A:
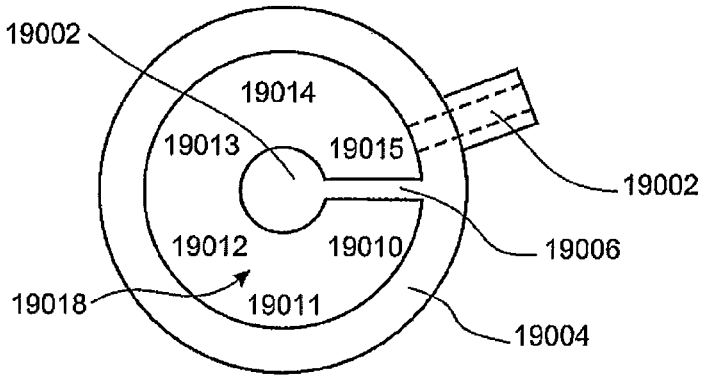
FIG. 19A is a end view of a cylinder head that provides multiple discharge paths of differing path lengths according to one embodiment of a further invention herein.
Figure 19B:
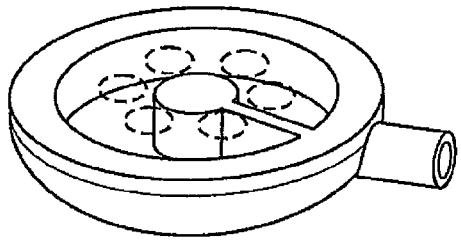
FIG. 19B is a perspective view of the head of FIG. 19A.

Referring to FIGS. 19A and 19B one example of a discharge head that can provide discharge pathways of different length is illustrated. In this head the discharge ports through the valve plate open into an essentially annular plenum 19018. The annular plenum is defined by a circumferential sidewall 19004 and a central clamping spigot 19008. A radial wall 19006 extends between the side wall 19004 and the spigot 19008. This intersects the plenum making an annular chamber, blind at both ends. An outlet 19002 is provided at one end of the chamber. Reference numerals 19010 to 19015 indicate the approximate location of the discharge ports into the plenum chamber with the discharge head in place. It is apparent that the path length from discharge zone 19010 to outlet 19002 is longer than the path length from discharge zone 19011, which is larger than the path length from zone 19012, which is longer than the path length from zone 19013, which is longer than the path length from zone 19014, which is larger than the path length from 19015.

This staggers the pulse arrivals at the outlet and thus reduces the pulsation in the discharge line. For example in the head of FIG. 19 the difference in path lengths (between maximum and minimum) is 60 mm, so that with a celerity of 230 m/s (speed of sound in Isobutane at 760 kPa and 120° C.) there is a delay of 0.26 ms between first and last pulse. This is about twice the rise time of an equal path length design.

Figure 21:
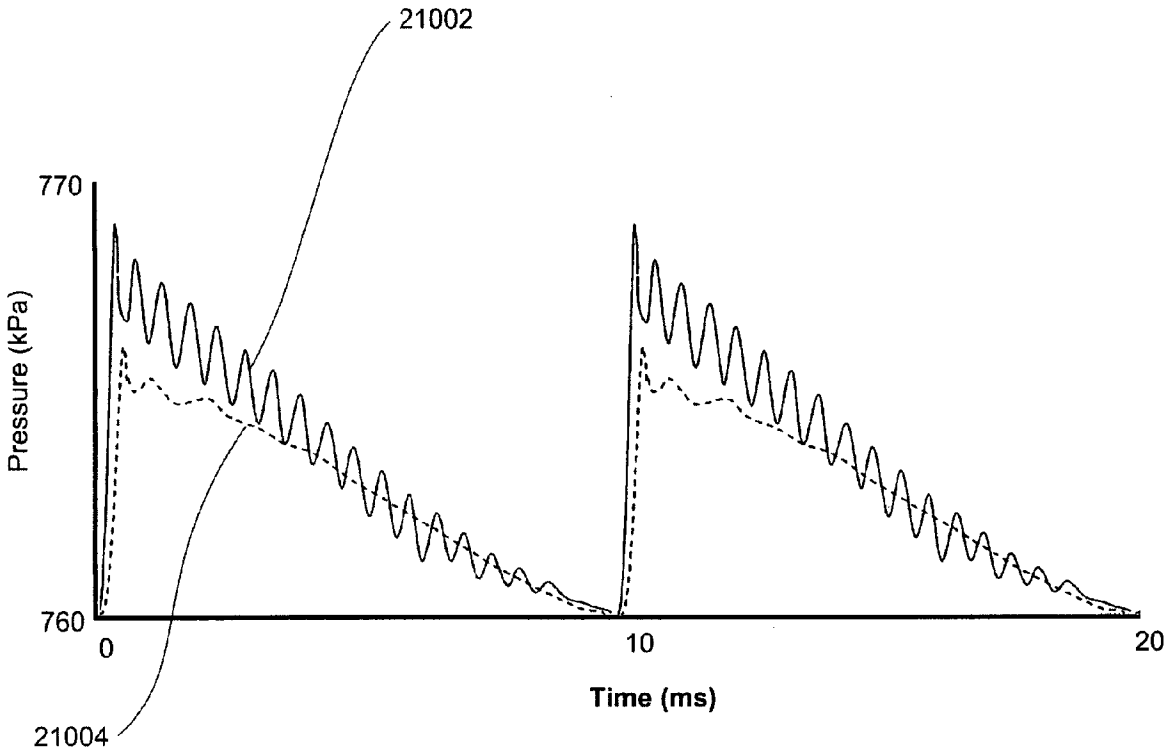
FIG. 21 is a pressure versus time plot showing smoothing of the pressure in the discharge cavity resulting from implementation of the embodiment of FIG. 19A.

FIG. 21 shows the difference in these pressure pulsations. The solid line 21002 is the pressure with equal path lengths, the dotted line 21004 for unequal lengths. The slower rise time of the unequal path design gives lower frequency harmonics that do not excite the resonances seen in the decaying section of the equal path trace.

Figure 36:
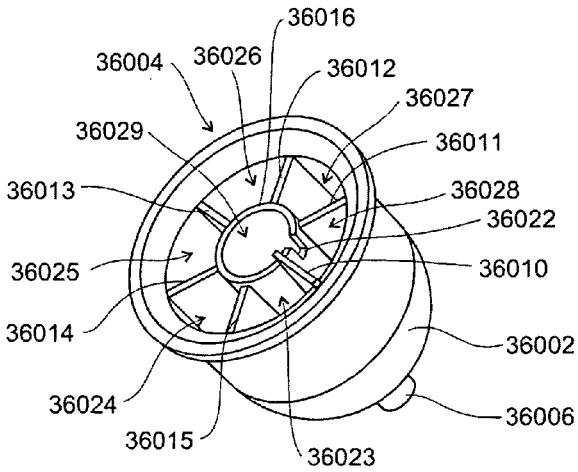
FIG. 36 illustrates a preferred embodiment of a discharge chamber according to a further invention herein.

Other embodiments of discharge head also embodying the varied discharge path length are illustrated in FIGS. 20 and 36. The arrangement of FIG. 20 has already been discussed briefly above. In addition to providing varied valve closing moments the arrangement of FIG. 20 provides an annular plenum chamber 20040. The outlet from this chamber is not illustrated, however preferably it is axial from central chamber 20042. Flow passes from the annular chamber 20040 to central chamber 20042 through an opening between the ends 20018 and 20044 of walls 20014 and 20016. Therefore in this arrangement the path length from valves 20024 and 20026 to the discharge outlet is greatest and from valve 20012 is lowest. The outlet passage could also be provided laterally through a sidewall of the discharge head, for example adjacent the opening between wall ends 20018 and 20044.

Referring to FIG. 36 another preferred discharge head is shown which has a similar arrangement to that in FIGS. 19 and 20. In this arrangement the discharge head includes a domed conical outer wall 36002 which defines a generally conical interior space 36004. An axial outlet passage 36006 extends from the apex of the discharge head. Internally the space 36004 is divided by an array of radial walls 36010 to 36015 and a central annular wall 36016. Annular wall 36016 defines a central axial chamber leading to outlet passage 36006 at the apex of the discharge head. Dividing walls 36010 to 36015 define a plurality of peripheral axial chambers surrounding the central axial chamber. It is intended that when assembled to the valve plate a discharge port opens into each axial chamber. Walls 36011 to 36015 are depressed below the level of annular wall 36016. Alternatively these walls may include a notch below the level of the annular wall. Annular wall 36016 includes a notch 36022 adjacent radial wall 36010. Radial wall 36010 is the same height as annular wall 36016. With the discharge head clamped in place against a valve plate the depressed level of walls 36011 to 36015 define a flow pathway from the peripheral axial chambers to the central axial passage. The path length from chamber 36023 to axial passage 36029 is longer than the equivalent path length from chamber 36024, which is longer than the equivalent path length from chamber 36025, which is longer than the equivalent path length from chamber 36026, which is longer than the equivalent path length from chamber 36027, which is in turn longer than the equivalent path length from chamber 36028. The axial chambers also act as a sound muffler in the discharge head.

According to a further invention herein the inlet ports and/or the discharge ports are provided with a valve that has a non-linear return force. As the valve opens, the stiffness increases. This has the advantage of not needing a stop to limit the travel of the valve. A stop is required in other designs so that the valve is not overstressed.

Figure 24:
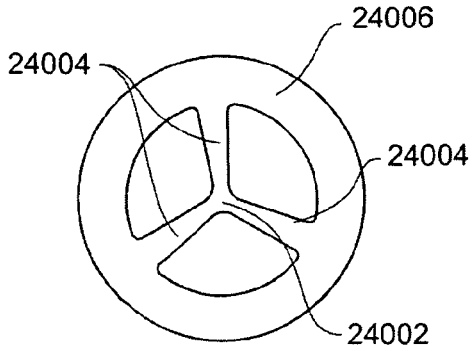
FIG. 24 is a plan view of a planar valve member according to another invention herein.

This may be implemented for the discharge valve as well, but our preferred form of discharge arrangement has been described above. One form of suction valve in accordance with the presently described invention is illustrated in FIG. 24. It has a hub 24002 in the centre with a plurality of spokes 24004 extending out to a continuous ring 24006 at its extremity. The valve preferably has an odd number of spokes.

The prevailing conditions for the suction valve make it difficult to get large valve displacements and therefore pressure drops can be relatively large unless the valve perimeter can be increased. Increasing perimeter is difficult as increasing port diameter can increase valve stress. According to our preferred embodiment the inlet port is an annular series of ports through the piston crown. FIG. 16 shows a piston end including such ports. This shape keeps stresses low but increases perimeter significantly. According to a further invention herein the perimeter ring 24006 of the preferred suction valve seals the annular series of ports. In accordance with both inventions the hub 24002 is fixed to the piston. The spokes 24004 act as valve springs. As the valve opens and the spokes 24004 deflect a tension arises in them resisted by the perimeter ring 24006. This tension inhibits additional deflection, increasing the valve stiffness. The induced tension increases as the valve opening deflection increases.

Figure 25:
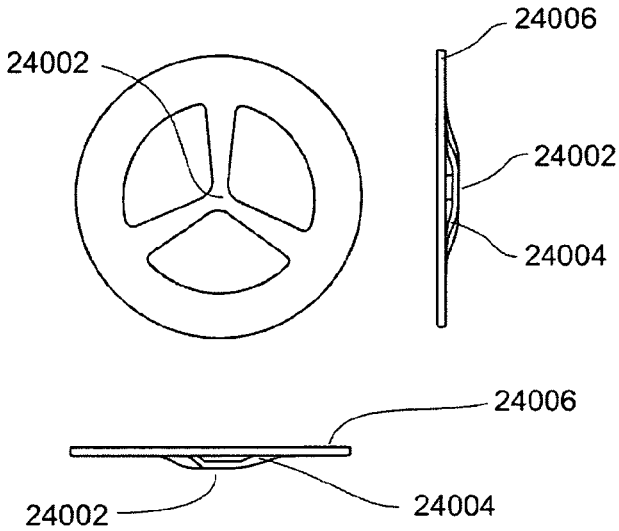
FIG. 25 illustrates a preferred mode of deflection of the planar valve member of FIG. 24.
Figure 26:
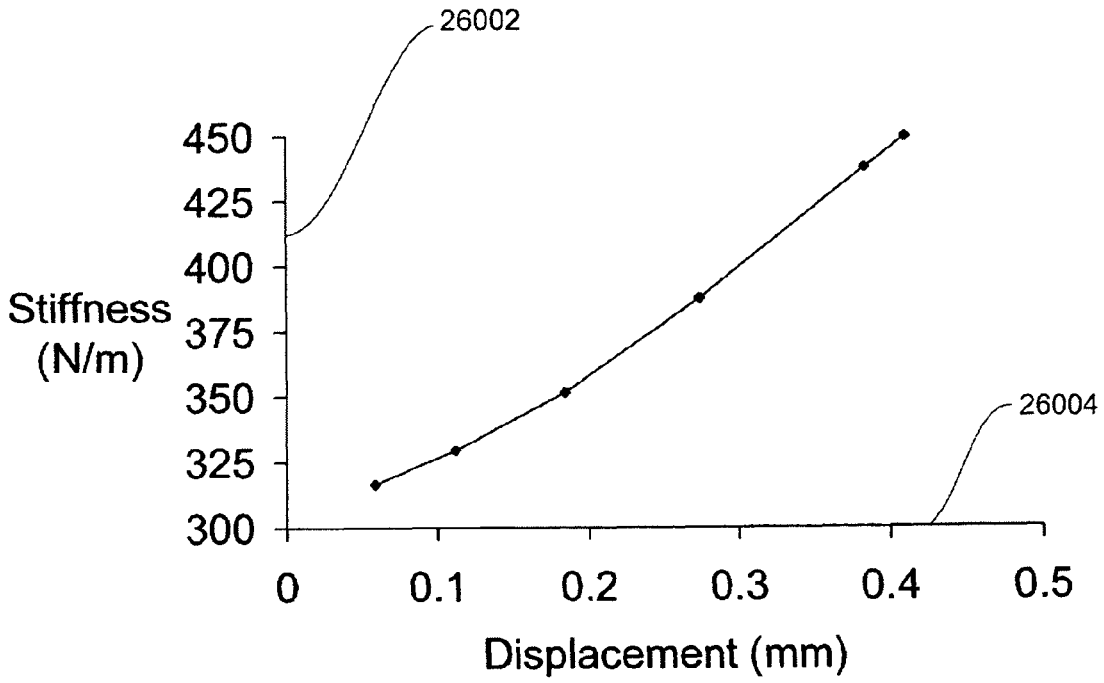
FIG. 26 is a plot of stiffness versus deflection illustrating the increasing stiffness for the valve member of FIG. 24 where the valve member is secured directly to a supporting face.

The valve is illustrated (orthographic projection) in FIG. 25 in its preferred mode of deformation. In the preferred mode of deformation the outer ring 24006 remains substantially planar, although it may deform under tension from spokes 24004 to slightly irregular or frustaconical. The hub 24002 may be secured to the piston crown so as to allow or to inhibit bending at its centre. A connection allowing bending at the centre of the hub reduces the valve stiffness comparative to a connection inhibiting bending at the centre of the hub. The increasing stiffness of such a valve, clamped tightly to the crown, is illustrated by the plot of FIG. 26. The plot places values of the instantaneous stiffness of the valve on vertical scale 26002 against values of the instantaneous opening displacement of the perimeter ring 24006 on the horizontal scale 26004.

Figure 27:
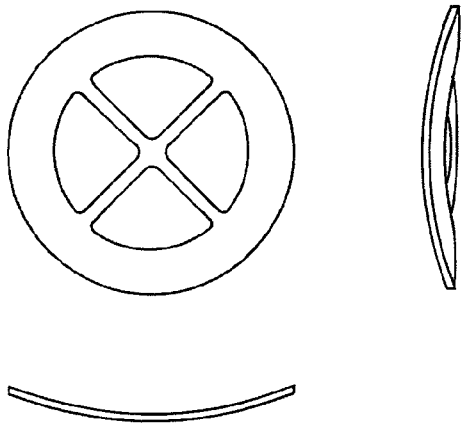
FIG. 27 illustrates an unwanted mode of deflection which results more frequently with a less preferred form of valve member as illustrated in FIG. 27.

It has been discovered that when the number of spokes is an even number, the symmetry of the valve is such that an undesirable deformation mode can occur in which two opposite sides of the valve tend to lift to a maximum while the two sides perpendicular to them, lift a minimum amount or sometimes not at all. This effect (illustrated in orthographic projection in FIG. 27) is not observed where the valve has a low odd number of spokes, in particular in valves having three or five spokes. Accordingly valves of three or five spokes are preferred.

Referring to FIG. 23 a variation on the valve having hub spokes and perimeter ring is illustrated. In this variation the spokes, although having a radial extent, follow a curving path between the hub 23004 and the perimeter 23008. Each spoke 23006 has an end 23010 proximal to the hub 23004 and an end 23012 proximal to the ring 23008. Each end preferably mergers into the respective hub or ring in a substantially radial direction. In path between ends 23010 and 23012 each spoke includes a portion 23014 extending substantially accurately within the space between the hub 23004 and the ring 23008. The valve member in accordance with this embodiment has a significantly lower stiffness than the valve member illustrated in FIG. 24. However the stiffness still increases with displacement.

According to another aspect of this invention the valve inlet such as described above may be mounted to the piston face in a floating arrangement. The valve displaces without deforming under the influence of prevailing pressures and piston acceleration. This means that there is no valve spring to close the valve, but since the valve closing should occur close to BDC where piston acceleration is at its peak there may be enough closing effect.

It is well known to those skilled in the art that if the suction gas is cooler, the density of the gas is increased and so the compressor is more effective at pumping. Therefore it is important to keep the suction gas as cool as possible. Many patents have been issued discussing methods of doing this. For example U.S. Pat. No. 4,960,368 and U.S. Pat. No. 5,039,287.

Most of the heat in a compressor is generated from the heat of compressing the gas into the discharge head. (The rest comes from the motor). Some of this heat is carried out with the discharge of the gas. The rest is dissipated to the surrounding volume and heats up the shell, which then dissipates heat to the ambient environment.

At the standardized test conditions with isobutane (International Standard ISO917 "Testing of refrigerant compressors") inlet gas at 60 kPa and 32° C. is compressed to 760 kPa. If this is an isentropic process (a good approximation for a high speed compressor) the temperature, $T_{discharge}$, can be estimated from;

$$T_{discharge} = (T_{inlet} + 273) \cdot \left[\frac{P_{discharge}}{P_{inlet}}\right]^{\left[\frac{k-1}{k}\right]} - 273$$

For isobutane with k=1.1 this gives a temperature of 111° C. This high temperature heats the gas surrounding the pump inside the shell (the shell gas). Since this gas mixes with the inlet gas before it is inducted into the pump, the temperature of the gas inside the cylinder at the start of compression is significantly higher than the 32° C. above. In some cases this temperature can be as high as 70° C. giving an isentropic discharge temperature of 158° C. Since the work of compression is found from;

$$W = \left[\frac{k}{k-1}\right] \cdot R \cdot (T_{discharge} - T_{inlet})$$

This increase in temperature gives an increase in work from 125 J/g to 140 J/g or a 12% increase in the power to pump the same amount of isobutane.

The prior art shows two ways of avoiding this temperature increase. Direct suction takes the inlet gas directly to the inlet port of the compressor. A small hole is provided in the inlet duct so that the shell gas stays at a similar pressure to the inlet gas. Semidirect suction has a much larger hole to the shell gas, this hole is designed to allow some flow to and from the inlet gas flow so that pressure fluctuations are minimised without significant heat or mass transfer. This overcomes the disadvantage of direct suction that gives large pressure drops because of the velocity fluctuations induced by the intermittent nature of the suction process.

Unfortunately semidirect suction is difficult to implement in a compressor where the suction valve is on the face of the piston.

According to one invention herein we attempt to limit the heat flowing from the discharge gas to the environs of the compressor.

In one aspect of our invention, the suction gas is admitted to the shell from the opposite end to the high temperature head and discharge line. It is therefore feasible to isolate the suction gas to some extent from the hot gas at the head end of the pump.

Figure 28:
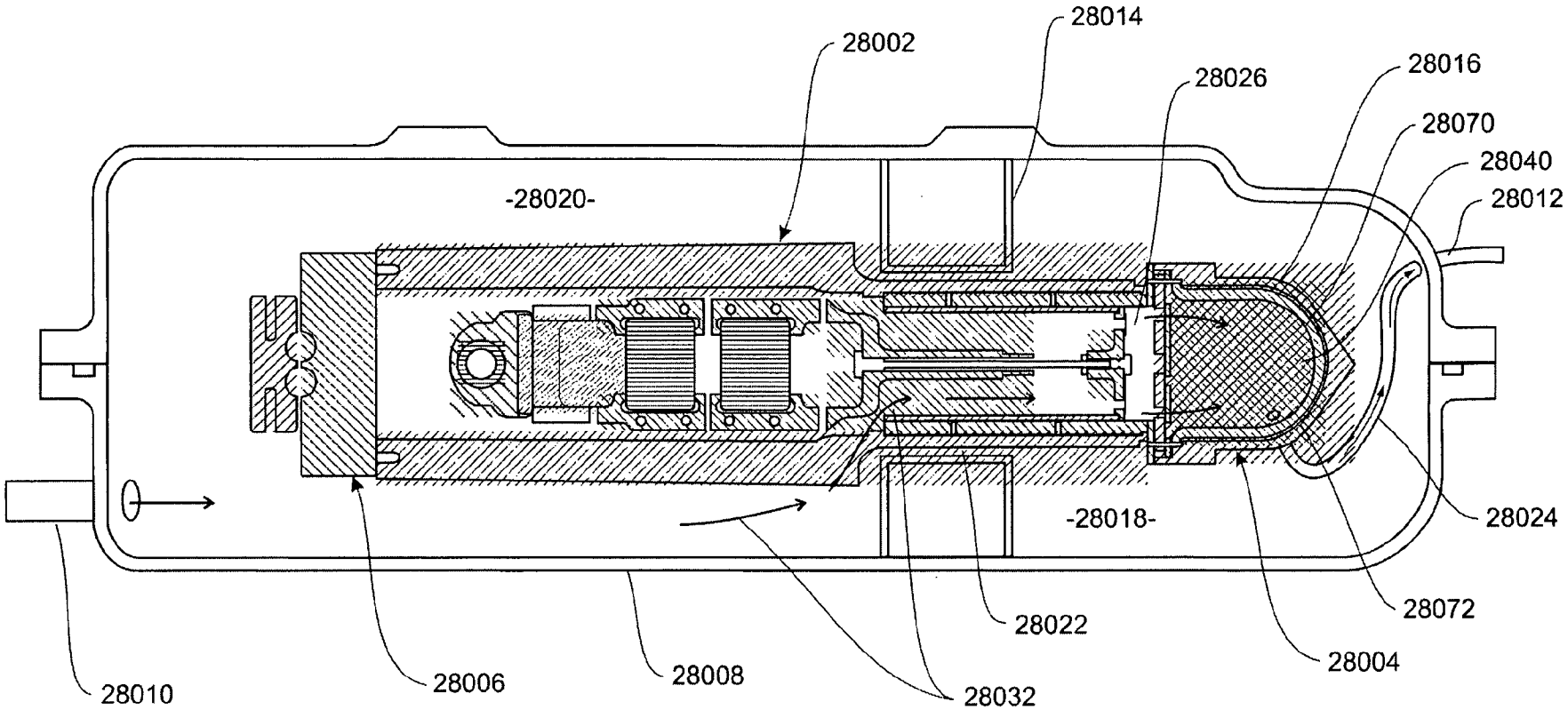
FIG. 28 is a cross sectional side elevation illustrating a housed compressor according to one embodiment of further inventions herein.

According to one embodiment the mixing of the gas from the head end of the compressor with the gas at the other end is restricted by a long baffle. FIG. 28 illustrates this embodiment. The compressor 28002 is elongate and includes a head end 28004 and an inlet end 28006. The compressor is arranged within an elongate enclosing shell 28008 and is preferably supported within the shell so that its movement is isolated from the shell. The shell 28008 includes a suction inlet 28010 and a discharge outlet 28012. An annular baffle 28014 is fitted within the shell 28008 at a point intermediate along the length of the compressor 28002. Preferably the baffle 28014 is located in the region of the cylinder of the compressor. The baffle 28014 divides the gases space within the shell 28008 into a head end gases space 28018 and a suction end gases space 28020. A limited annular clearance 28022 is provided between the baffle 28014 and the compressor 28002 which will allow for movement of the compressor in operation. The suction inlet 28010 enters to suction gases space 28020. The discharge outlet 28012 is from head space 28018 and connects to the compressor discharge head 28016 via a flexible discharge pipe 28024. The discharge pipe 28024 passes only through the head end space 28018. With the compressor operating, suction gases enter the shell through suction inlet 28010 and are drawn into the compression space 28026 through the suction space 28020 and the body of the piston 28028. This flow is indicated by arrows 28032. Gases discharge from the compression space 28026 into a chamber 28040 within the discharge head 28016 and from there through the discharge tube 28024 to exit the shell at discharge outlet 28012. In this arrangement the hot discharge gases are only in contact with the head end of the compressor, which in turn discharges heat into the gases of surrounding space 28018. These gases are substantially isolated from mixing with the suction gases in space 28020 by the baffle 28014. In this arrangement the suction gases are somewhat lower temperature than if free mixing was allowed with the gases around the cylinder head.

Figure 29:
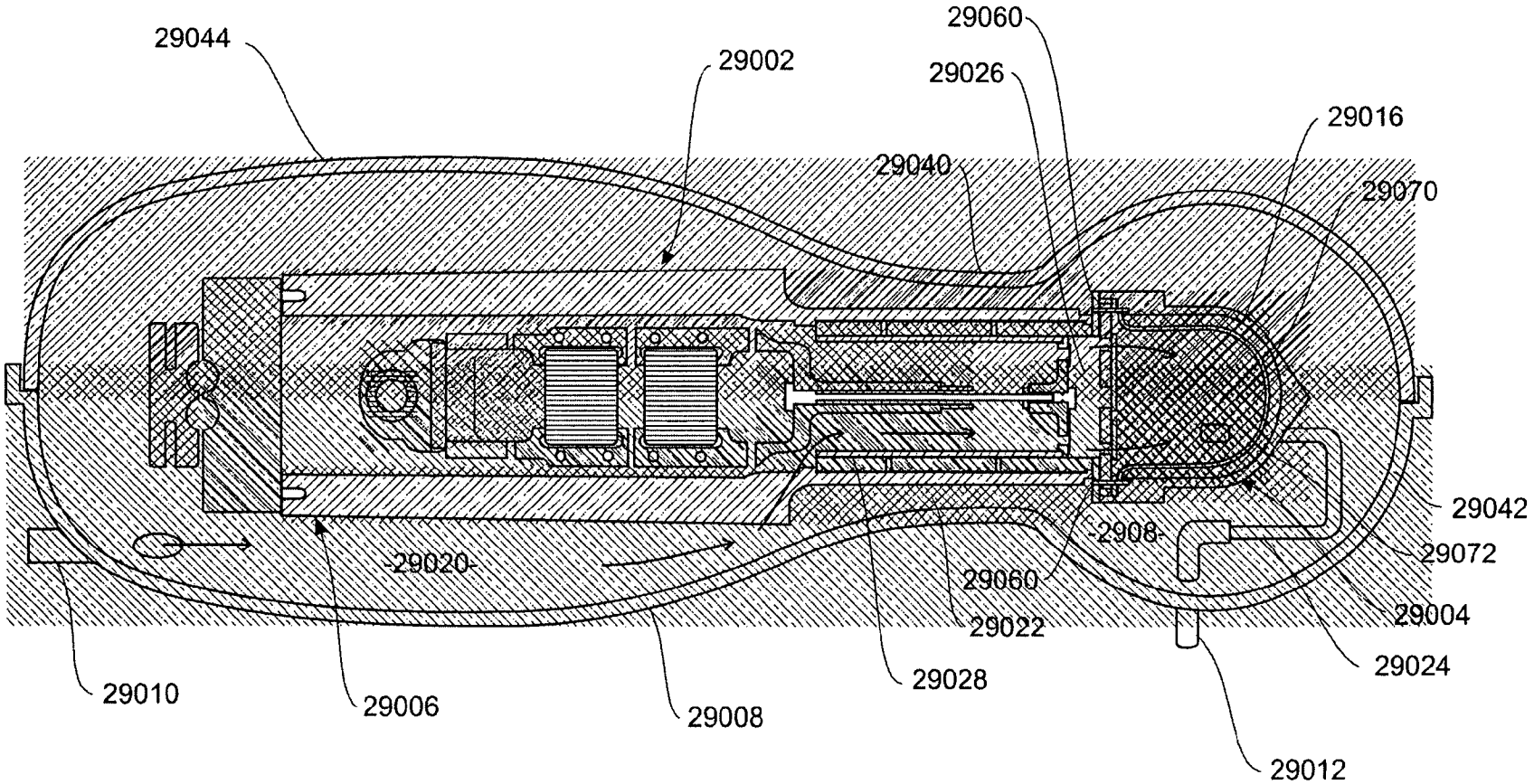
FIG. 29 is a side elevation in cross section of a housed compressor according to another embodiment of further inventions herein.

The baffle that restricts gas movement from end to end could be added to the inside of the shell as in FIG. 28 or it could be formed as part of the shell during the shell manufacturing process as in FIG. 29.

In the embodiment of FIG. 29 the compressor shown housed in the shell is substantially the same as the compressor in FIG. 28. The compressor 29002 is elongate and has a head end 29004 and a suction end 29006. The compressor is arranged within elongate shell 29008. The shell 29008 has a first lobe 29042 at one end and a second lobe 29044 at the other end. A waist or neck 29040 lies between the lobes 29042, 29044. The waist or neck 29040 approaches the outer surface of the compressor leaving a narrow annulus 29022 for movement clearance for the compressor. The shell 29008 includes a suction inlet 29010 and a discharge outlet 29012. The head 29016 and discharge pipe 29024 both lie fully within the first lobe 29042. The suction gases pass from the suction inlet 29010 to the compression space 29026 through the interior 29020 of the second lobe 29044 and the interior of piston 29028. Thus they are to some extent isolated from mixing with gases heated by the discharge head 29016 and discharge line 29024.

The shell arrangement of FIG. 29 is also a preferred embodiment of another invention herein. This invention relates generally to shells suitable for elongate compressors. In the prior art, compressors for domestic refrigeration appliances have typically been housed within rotund shells of low aspect ratio. Compressors fitted within such shells have also been of low aspect ratio. One advantage of a linear compressor such as those that have been described herein, is that they can be constructed to be elongate, or have a high aspect ratio. Housed in a shell having a similar aspect ratio to the compressor, the compressor can thus occupy a lower dimension in at least one axis. In domestic refrigeration appliances this can reduce the volume of the required machine space and/or improve the available internal shape of the refrigerator. The inventors have discovered that the elongate shells that have previously been tried for housing an elongate compressor have contributed to an overly noisy compressor unit compared to more conventional compressors housed in a more uniformly proportioned shell. The inventors consider that the shapes of prior art shells have provided lower resonant frequencies more easily excited by the housed compressor. In particular the lower resonant frequencies can be excited by lower order harmonics of the operating compressor than the higher resonant frequency shells of more conventional aspect ratio. These lower harmonic have greater associated energy leading to greater excitation of the shell and more noise. In solution to this problem the inventors propose a shell shape for housing an elongate compressor that has higher lowest resonant modes. The inventors' proposed designs have higher inherent shape stiffness and therefore higher lowest resonant modes. Preferred features of the shape include an annular hollow in the outer surface, such as exhibited by the waist or neck 29040 in FIG. 29, and a lack of straight lines taken in any direction. In particular a shape as in FIG. 29 having a first and a second lobe, each of rounded form, joined at a waist of rounded form has been found to exhibit low noise characteristic in comparison with a more cylindrical shell such as that depicted in FIG. 28. It is considered that each lobe of the shell of FIG. 29 more approximates a sphere which has the ultimate shape stiffness. The frequency of the lowest excited mode with the shell of FIG. 29 is more than 30% higher than the lowest excited mode of a similarly sized shell such as in FIG. 28. It is also considerd that the shell of FIG. 29 is effective as the lack of linear surfaces discourages standing wave formation and encourages "random" internal reflections. Accordingly internal attenuation of noise is improved. The taper into the narrow annulus region 29022 is also considerd to be effective in attenuating the internal noise, acting as a muffler.

According to a further aspect of our invention the discharged gas is thermally insulated, both from the shell gas and from the body of the compressor. With reference to FIGS. 28 and 29 the preferred method of insulating the head is to have a liner (28070, 29070) inside (or outside) that traps a thin layer of gas (28072, 29072). This gas cannot convect, since the small distance across the gap ensures that the torque applied to the fluid is too weak to form convection cells so that heat is transferred only by conduction through the gas (this is low because most gasses are very poor conductors) and by radiation (that can be minimised by reducing the emissivity of the surfaces).

The optimum width of the gap will vary according to the intended conditions of use for the compressor. If the parameters are such that the Rayleigh number is below $2\times10^4$ here will be little convection. For example, with isobutane and a 50° temperature difference between the expected temperature of the internal and external walls in steady state operation a Rayleigh number of $2\times10^4$ suggests a gap of approximately 2 mm. Any increase in the size of the gap will give little or no further reduction in heat transfer, but will detrimentally increase the surface area of the outside of the head.

Insulating the head inevitably increases the average temperature of the valve plate and this can conduct more heat into and along the cylinder body. According to a further aspect of our invention a thick low conductivity gasket (e.g. 29060 in FIG. 29) is provided between the head and the cylinder to reduce heatflow down to the suction end of the pump.

The gasket is preferably a polymer material and has a thermal conductance and thickness giving a thermal conductivity less than 1000 $W/m^2K$, for example a 1.5 nm thick gasket of Nitrile rubber binder with synthetic fibre filler has a thermal conductivity of approximately 600 $W/m^2K$.

Because the cylinder and thus the stator vibrates +/−1 mm, there can be reliability problems with the electrical connections to the linear motor. The same problem can also occur in relation to the discharge conduit.

Advantage can be gained by eliminating electrical connections by leading the "winding" wire directly to the "fusite" hermetic connector attached to the housing.

According to one invention herein a particularly configured path from the moving compressor to the fixed connector keeps fatigue stresses to a minimum. A preferred embodiment of this path for the electrical connection is illustrated in FIG. 34 and FIG. 35.

Each lead 3400, 3402 has a moving loop in a plane parallel to the direction of movement. The ends of the loop are connected to resist bending moments and act as "built in" ends. The preferred loop includes a first straight section 3404 connected with the moving component (the assembled compressor) and a second straight section 3406 connected with the fixed component, the compressor shell. The first and second straight sections 3404 and 3406 are both parallel with the axis of reciprocation of the piston, which is main source of vibration of the compressor. A third, transverse, straight section 3408 extends between the first straight section 3404 and second straight section 3406. Radius corners 3407 and 3409 join the first and third and second and third straight sections respectively. The radius of curvature of corners 3407 and 3409 are preferably selected to be as small as possible, but taking into account convenience of manufacture and the strain limitations of the material. The curve must not be so small as to induce stress raising defects.

Preferably the ends of the loop are not the ends of the wire per se, the wire being a continuous extension of the wire of the stator winding and being lead in an unbroken path to the fusite connector through a compressor shell. However as the ends of the loop are essentially built in and held rigid in relation to the respective compressor component to which they connect conductive joins in the wire are not as detrimental as they might otherwise be. Preferably each end of the loop is held within a channel with a depth considerably greater than the diameter of the wire. The wire fits tightly within the channel and the channel is connected to the respective component. For example wire end 3460 is fitted into a channel 3463 of an open sided conduit which is in turn fixed to the compressor shell. End 3462 is fixed into an open channel 3467 extending from an end face of a plastic bobbin 3468 holding the stator winding. The wire leads into the channel to a depth considerably greater than the diameter of the wire.

Figure 32:
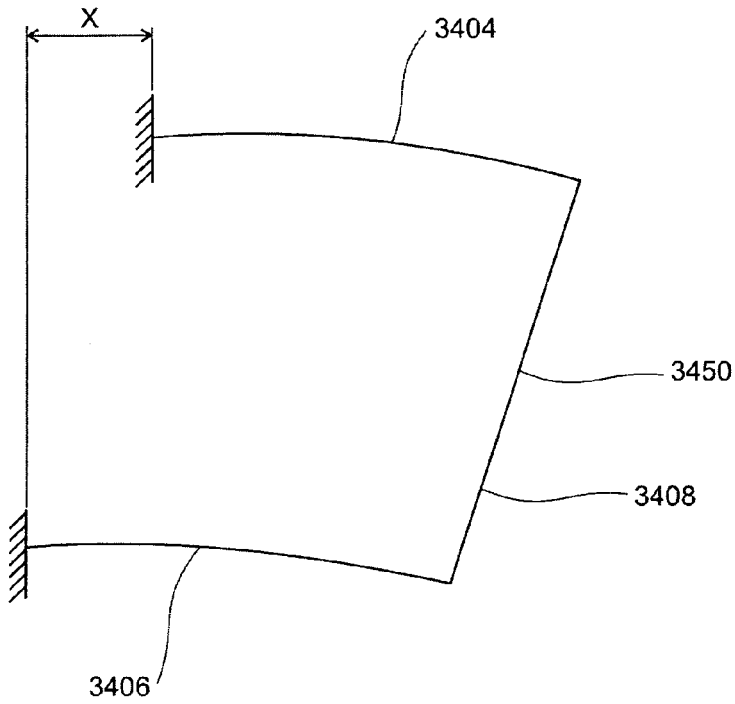
FIG. 32 is a diagrammatic representation of an electrical connection path according to a preferred embodiment of a further invention herein, shown in an exaggerated displaced mode.
Figure 33:
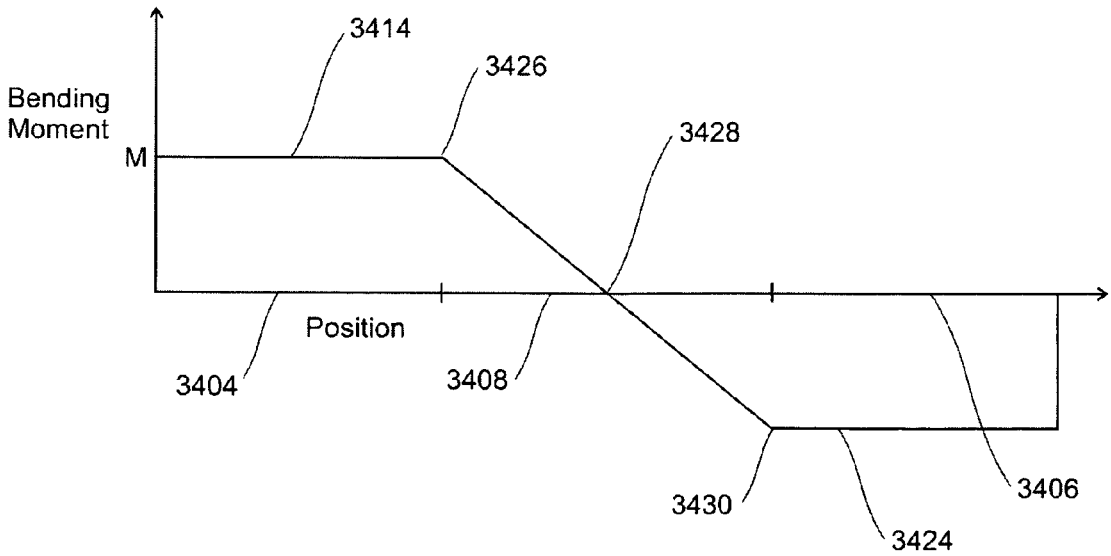
FIG. 33 is a bending moment diagram illustrating the bending moment at positions along the path of the wire in FIG. 32.
Figure 34:
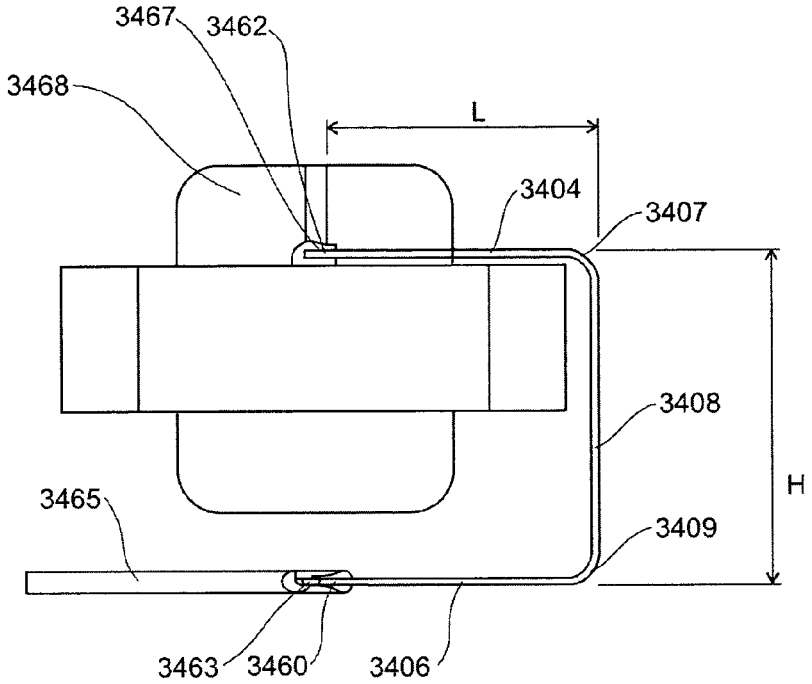
FIG. 34 is a side elevation of a preferred embodiment of the electrical connection path of FIG. 32.
Figure 35:
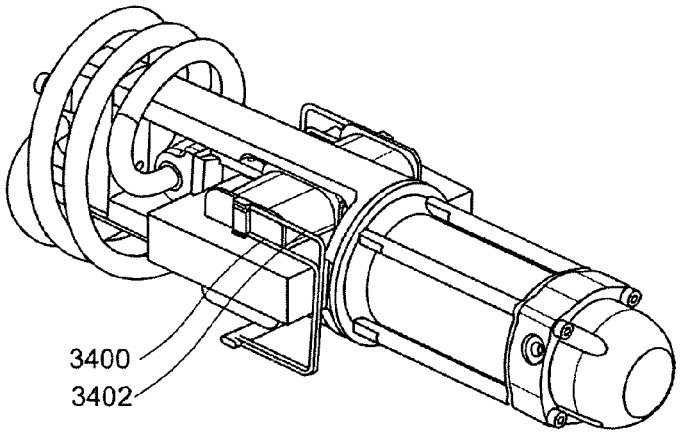
FIG. 35 is a perspective view of a compressor including electrical connections according to FIG. 34.

Referring to FIG. 34 the first and second straight sections 3404 and 3406 have a length L. Transverse straight section 3408 has a length H. The loop is shown in solid line in an undeformed mode. A deformed mode is illustrated in FIG. 32 following displacement of the vibrating compressor a distance X. Generally the compressor of the present invention will vibrate through a displacement range of +/−1 mm, and effective lengths of the straight sections have been found with L in the order 10-20 mm and H in the order 20-30 mm. The deformed mode shown in FIG. 32 is exaggerated.

FIG. 32 shows a theoretical bending moment distribution along the wire. The bending moment distribution is somewhat idealised, with the radius of the corners assumed zero.

In the bending moment distribution it can be seen that the built in ends of the parallel straight sections 3404 and 3406 and the alignment of these sections with the direction of displacement of the moving compressor relative to the shell results in pure bending (constant bending moment 3416 and 3422 respectively) along the length of the parallel straight sections 3404 and 3406. The magnitude M of this uniform bending moment is the peak bending moment along the length of the wire loop. The bending moment 3414 in the first parallel section 3404 is equal in magnitude to the bending moment 3424 in the second parallel section 3406 but is of opposite sign. The bending moment in the transverse section 3408 is not uniform, but is characterised by a uniform sheer force effecting a linear transition between the bending moment 3426 of equal magnitude and sign to bending moment 3414 in first parallel section 3404, and bending moment 3430, equal in magnitude and sign to bending moment 3424 of second parallel section 3406. At a point 3428 halfway along transverse section 3408 the bending moment is substantially zero corresponding with the point of inflexion 3450 in the deformed mode illustrated in FIG. 34. From point 3428 the bending moment rises linearly, as represented by region 3418 to peak 3426, and linearly but with opposite sign, as in region 3420, to peak 3430.

The magnitude of this maximum moment M is found from:

$$M = 12 \cdot E \cdot I \cdot \frac{x}{h \cdot (6 \cdot L + H)}$$

Where E, I and x are the modules of elasticity (1600 GPa for Cu), the moment of inertia and the displacement respectively. The maximum alternating stress for wire of diameterd is given by:

$$s = M \cdot \frac{d}{2 \cdot I}$$

For a given length of connecting wire an optimally low M is given by L=⅙ H according to the theoretical calculations. However, the model does not take into account vertical forces generated by the deformation. In practice these are best reduced by choosing to use longer parallel arms. The model shows that the stress is more sensitive to variations in H than to variations in L. This is verified by our experience where the most unreliable designs have had a relatively small H. Also we have found that if L is too large higher mode oscillations can occur.

This invention may also be applied to other connections between the compressor and shell such as the compressed gases discharge line. Such a configuration is illustrated in FIG. 29.

Compressors in domestic refrigerators can be a significant source of annoying noise, either directly or indirectly through vibration that is transferred to other noise generating components.

A significant portion of the noise and vibration levels in a compressor is generated by gas pulsations on the suction side and the discharge side. Another is the impact of the valves on the surfaces that surround the ports.

Figure 30:
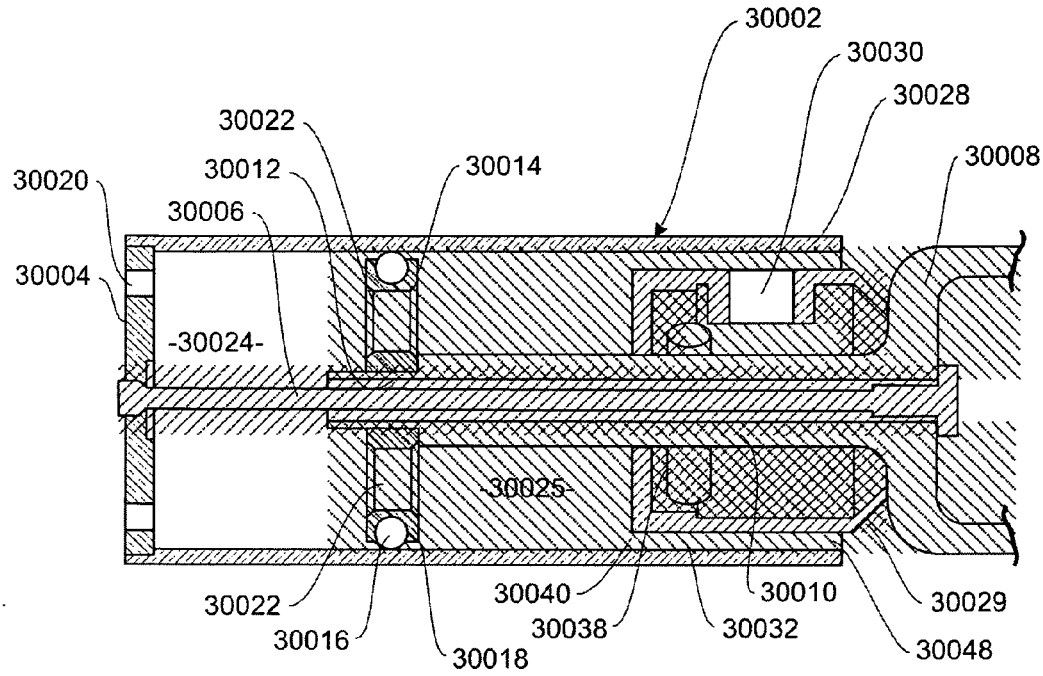
FIG. 30 is a cross sectional side elevation of a piston including gases suction pathway and tuned muffler according to a preferred embodiment of a further invention herein.

According to a further invention herein a tuned volume is provided within the piston, created by an addendum at the open end of the piston. The addendum is shaped to create the right volume to inlet ratio to form a tuned Helmholtz resonator at a frequency(s) close to the operating frequency(s) of the linear compressor. FIG. 30 illustrates a preferred embodiment.

FIG. 30 is a side elevation in cross section of a preferred piston assembly incorporating several of the inventions in this application. This piston assembly includes a piston sleeve 30002, and a piston crown 30004. An axially stiff laterally compliant rod 30006 is connected to the inward face of piston crown 30004. The axially stiff laterally compliant rod is fixed to a piston rod 30008 at an end distal from the crown 30004. The piston rod 30008 extends to the compressor main spring and carries the linear motor magnets. An annular cantilever 30010 from the piston rod extends axially toward the piston crown 30004 around the compliant rod 30006. The cantilever 30010 includes an annular rebate 30012 at its open end. A transverse disc 30014 is fitted to this rebate 30012. The transverse disc 30014 extends to adjacent the inner surface of the piston sleeve 30002. An O-ring 30016 is situated within a rebate 30018 and bears against the inner surface of the piston sleeve. The piston crown 30004 includes a series of suction ports 30020 as an annular array adjacent its periphery. Suction gases for the compressor pass through the piston. The disc 30014 includes a plurality of apertures 30022 arranged around the area between its hub which connects onto the cantilever 30010 and its rim which receives the O-ring 30016. The disc 30014 divides the open space within the piston into a first chamber 30024 and a second chamber 30025. The chambers 30024 and 30025 are connected by apertures 30022. A chamber 30029 is fixed to the piston rod 30008 in the open end 30028 of the piston sleeve 30002. The chamber 30029 has an entrance 30030 opening into an annulus 30032 defined between the outer surface of chamber 30029 and the inner surface of the open end of the piston sleeve. The entrance 30030 includes a stub tube projecting into the chamber 30029 a short distance.

A blind ended tube 30038 also extending into the chamber 30029 also opens into annulus 30032. The blind ended tube 30038 is not open to the interior of chamber 30029.

This arrangement provides for an advantageous combination of noise reducing features in a compressor arrangement with suction flow through the piston. In particular, the chambers 30024 and 30025, connected by passages 30022 through the disc 30014, with a restricted entrance to chamber 30025 (provided by annulus 30032) act as a good muffler. The volume in chamber 30029 and the dimensions of entrance 30030 are chosen to act as a Helmholtz resonator tuned to remove a medium frequency pulsation, for example that might be induced by incidentally added by the muffler. Tube 30038 acts as a quarter wave side branch resonator removing a higher frequency pulsation. The position, length and area of apertures 30022 and the dimensions of annulus 30032 are also tuned to phase pressure pulsations in the suction side of the piston to improve induction into the compression chamber through the piston crown.

Figure 31:
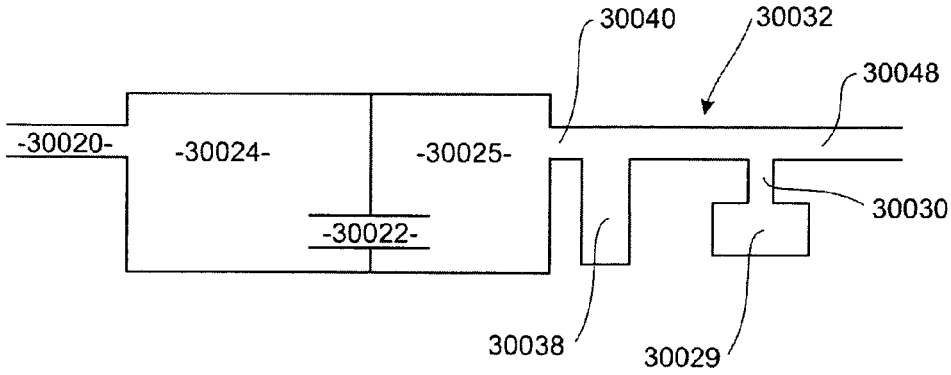
FIG. 31 and FIGS. 31A to 31D illustrate the effect of various features of the piston of FIG. 30.
Figure 31A:
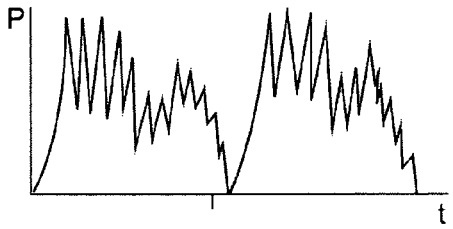
Figure 31B:
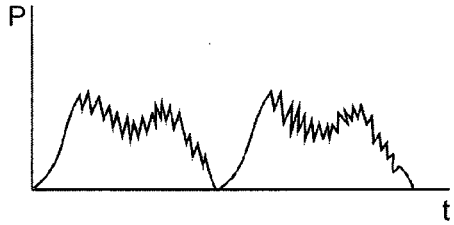
Figure 31C:
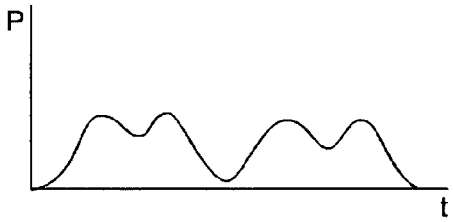
Figure 31D:
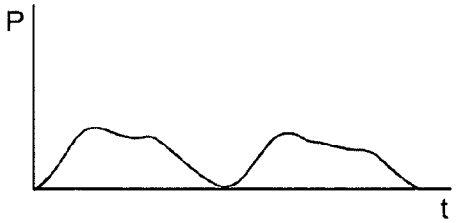

FIG. 31 is illustrative of the theoretical equivalent of the arrangement of FIG. 30. FIG. 31A illustrates a hypothetical pressure versus time waveform at suction port 30020. FIG. 31B illustrates a hypothetical versus time waveform at the exit 30040 of the annulus 30032, the major peaks of the waveform having been attenuated by the muffler formed by the chambers 30024 and 30025. FIG. 31C illustrates the hypothetical waveform in the annulus 30032 between the resonator tube 30038 and the entrance 30030 to chamber 30029. A further selected high frequency is removed by the quarter wave side branch resonator. FIG. 31D illustrates the hypothetical waveform at the entrance 30048 to annulus 30032. A remaining selected dominant waveform has been removed, leaving a waveform having a dominant fundamental frequency, corresponding with the running frequency of the compressor.

In the prior art it is common practice to support a compressor within an enclosed shell. The supporting arrangement which is commonly used is a plurality of coil springs. Each coil spring is secured to the shell at one end and to the compressor at its other end. Each connection is formed to transmit moment, such as by fitting over a rubber end node. The component of the compressor to which the springs vibrate is generally intended to undergo a oscillatory motion with the compressor operating. The springs are arranged below the compressor such that the oscillatory motion produces lateral deflection in the springs. Coil springs are comparatively soft to lateral deflection but do provide some centering effect. However this centering force generates a resulting torque which is in turn constrained by linear deflection of the supporting springs. This results in a rocking motion of the compressor about an axis parallel to the plane of oscillation resulting from driving the compressor. The inventors consider that this additional rocking motion is a source of noise and vibration.

Referring to FIGS. 13, 14, 37 and 38, according to a further invention herein, the arrangement of the supporting springs, and in particular their length and the position of their connection to the compressor and the shell, is chosen so that no net torque results on the compressor by the centering force from the support springs.

According to one aspect of this invention these parameters are chosen so that the torque required to keep the upper support spring ends parallel during lateral movement is the result of the return force acting about the centre of mass of the moving compressor component.

Figure 37:
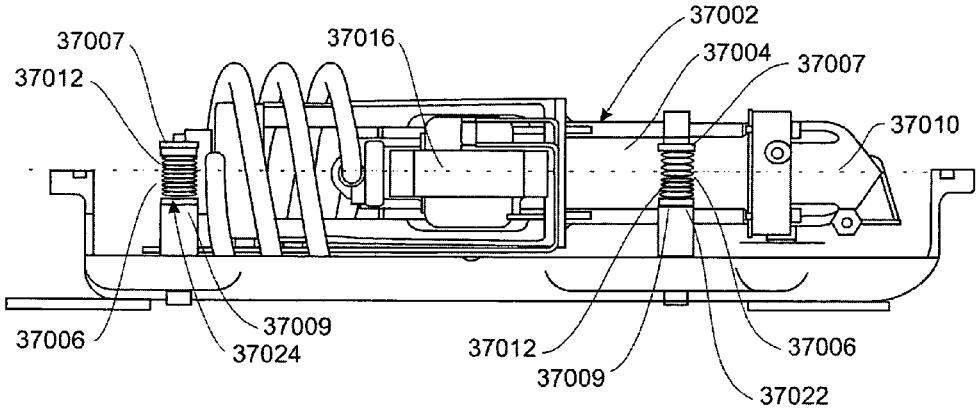
FIG. 37 is a side elevation, partially cross sectioned, of a housed compressor (with top half of housing removed) illustrating a coil spring support arrangement according to a preferred embodiment of a further invention herein.
Figure 38:
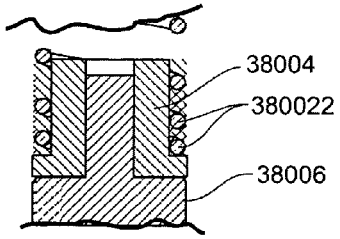
FIG. 38 is a cross sectional side elevation illustrating a manner of mounting an end of a coil spring so as to transmit bending moment.

For support springs that are symmetric along their free length the preferred arrangement is that the midpoints of the springs are co-planar with the plane of oscillation (or reciprocation) of the centre of mass of the moving part. A preferred embodiment for a linear compressor is illustrated in FIG. 37. In this embodiment the compressor 37007 is also vertically symmetric and the cylinder housing 37004 has essentially a single axis of movement under operation. This axis coincides with the centreline 37010 of the compressor cylinder. The springs 37006 each connect to an upper mounting point 37007 on the housing and to a lower mounting point 37009 on the shell. Each connection is a moment transmitting connection behaving as a "built in end". One preferred form of connection is illustrated in FIG. 38 and includes fitting the end coils 38002 of each end of each spring over a corresponding spigot 38004 fitting tightly within the coil of the spring. The spigot 38004 is rigidly connected to the respective compressor or shell, for example bonded to post 38006. Spigot 38004 is preferably a stiff plastic.

In the preferred form of this invention the coil springs are symmetric about their midpoint 37012 and the characteristics of the manner of securing the spring to the compressor and shell are the same at either end of the spring. Accordingly the centre of bending (as defined herein) of each connection between the compressor and shell is at the midpoint of the respective spring. Alteration of the spring geometry and/or the character of the respective mounting points would lead to an alteration in the centre of bending of each connection between the linear compressor and the shell. Accordingly for optimal performance in accordance with this invention the resulting centre of bending should be in the plane of oscillation of the centre of mass of the cylinder assembly.

As well as coil springs, the present invention envisages the potential for use of other support members providing a centering force but being generally considerably less stiff laterally than axially. For example, substantially vertically aligned leaf springs may be possible given the linear nature of the expected oscillation in a linear compressor.

As the preferred linear compressor is substantially vertically symmetric about its centreline (not including the main spring which is still balanced about this centreline, the centre of mass of the cylinder assembly, which includes all of the components that are in a fixed and substantially rigid relationship relative to the cylinder) is on the centreline 37010 of the compressor. In operation all of the components of the compressor that are driven relative to the cylinder assembly also have their centres of mass on the centreline of the compressor. The moving masses reciprocate such that their centres of mass oscillate along the centreline of the compressor. The compressor is substantially freely suspended on the supporting springs 37006 apart from the compressed gases outlet connection at the head end, which is of very low stiffness. Accordingly the cylinder assembly oscillates in opposition to the motion of the piston parts, with the centre of mass of the whole linear compressor remaining substantially stationary. Accordingly the centre of mass of the cylinder assembly oscillates along the centreline of the linear compressor 180° out of phase with oscillation of the piston part.

Because the oscillation of the cylinder part is essentially along a single line the plane of oscillation can be any plane that incorporates this line. For simplicity a horizontal plane is preferred. Other orientations might require a more elaborate arrangement of the springs and mounting points. Therefore for the midpoint of the springs to coincide with the horizontal plane through the centreline of the compressor it is preferred that the springs lie outside the periphery of the compressor, with a plurality of springs placed around the periphery of the compressor so that each spring takes a substantially equal share of the compressor weight. For the compressor illustrated in FIG. 37 where two pairs of support springs are provided, the springs of each pair being mounted on opposite sides of the compressor, this is achieved by supporting the compressor so that the centre of mass 37016 of the compressor is located midway between the first pair of springs 37022 and the second pair of springs 37024.

According to another aspect of the invention the arrangement of the supporting springs is chosen such that the torque resultant from any single spring is balanced by the torque from other springs terminating in the immediate vicinity. One embodiment according to this aspect is illustrated in FIG. 13, and another embodiment is illustrated in FIG. 14.

Figure 13:
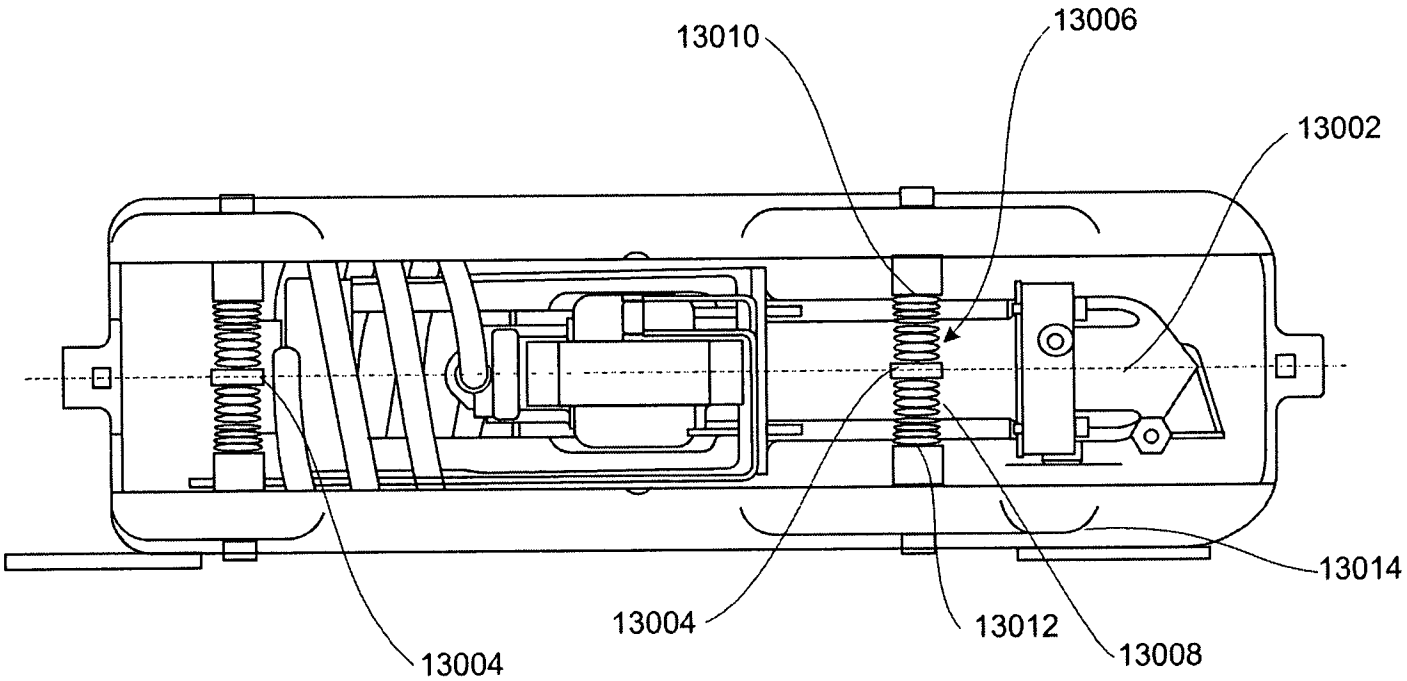
FIG. 13 is a side elevation, partially cross sectioned, of a housed compressor including a coil spring support arrangement according to one embodiment of a further invention herein.

In the embodiment of FIG. 13 the isolation springs connect to the compressor at mounting locations 13004 on the plane oscillation 13002. At each location 13004 an upper spring 13006 and a lower spring 13008 abut on opposite sides of the mounting. The upper spring 13006 extends to connect with a moment resisting connector 13010 fixed with the upper region of the compressor shell. The lower spring 13008 connects to a lower moment resisting connection 13012 fixed to a lower portion 13014 of the shell. The upper spring 13006 and the lower spring 13008 are preferably selected so that with the compressor in place within the shell and resting on the lower springs the length of the upper and lower springs and lateral stiffness of the springs is substantially the same. The connection of the upper and lower springs to compressor mount 13004 is also a moment resisting connection, for example as depicted in FIG. 38.

In operation of the compressor of FIG. 13 the linear (or planar) oscillating motion is allowed by lateral deflection of the springs. Each individual springs applies a reaction torque to its respective compressor mount 13004. However the reaction torque applied by each lower spring 13008 is countered by the reaction torque applied by corresponding upper spring 13006.

Figure 14:
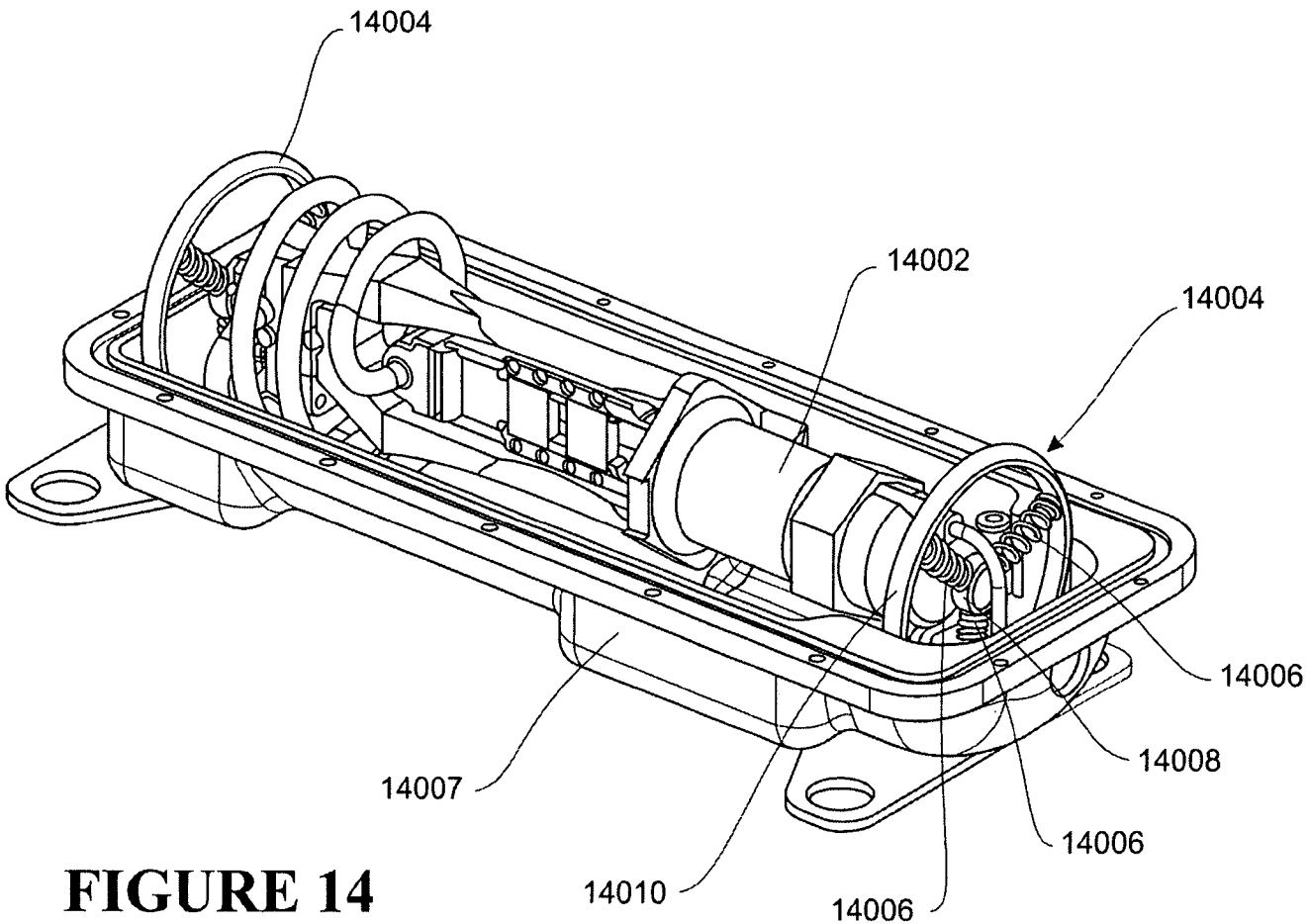
FIG. 14 is a perspective view of a housed compressor (with top half of housing removed) illustrating a coil spring support arrangement according to another embodiment of an invention herein.

The embodiment of FIG. 14 is particularly adapted for a linear compressor which exhibits a linear oscillating motion rather than a planar oscillating motion. With a planar oscillating motion that is not linear it is desirable that the axes of the isolating springs are all parallel and perpendicular to the plane of oscillation. Where the oscillation is linear it is only desirable that the springs are parallel and perpendicular to the axis of oscillation. This is recognised in the embodiment in FIG. 14. An isolating support is provided at either end of the compressor 14002. Each isolating support 14004 includes a plurality of supporting springs 14006. The isolating springs 14006 extend from a central hub 14008 to a surrounding ring 14010. One of the hub or ring is fixed to the compressor 14002. The other of the hub or ring is fixed to the compressor shell 14007. Although it is illustrated with the surrounding ring this is only for convenience. The peripheral support for the springs could be direct to the shell or compressor or to extensions therefrom as desirable. In the embodiment illustrated the central hub 14008 is connected to the compressor substantially on the centreline so that the axes or springs are perpendicular to and intersect the centreline of the compressor. The supporting ring 14004 assists with assembly of the compressor, allowing the compressor assembly to be dropped into a lower half shell fully supported with the upper half shell subsequently fitted. Each spring 14006 may be connected at either end with a moment resisting connection as described earlier with reference to FIG. 38. In operation of the compressor any reaction torque applied by one of the springs in either set is counteracted by the reaction torques applied by the other springs of the same set accordingly these applied torques are balanced within the axial location of the isolation support to the compressor leaving no resultant torque and therefore requiring no resultant reaction force at the other supporting location.

The invention claimed is:

1. A housed compressor comprising:

an elongate compressor having a piston reciprocable in a cylinder, and an elongate hollow shell surrounding said compressor and having a gases space within, where said gases space is between the cylinder and the shell, the outer surface of said shell having at least one significant annular hollow transverse to the axis of elongation, a suction gases inlet to said shell gases space, and a suction gases pathway from said gases space into said cylinder, a compressed gases path from said cylinder out of said shell, said elongate compressor supported within said shell so that it passes said hollow, said annular hollow substantially dividing said gases space within said shell into a first region of gases space and a second region of said gases space, and substantially inhibiting gases flow between said first and second regions, said suction gases inlet opening to said second region, and said compressed gases path passing through said first region.

2. A housed compressor as claimed in claim 1 wherein said first region is substantially defined by a first lobe and said second region is substantially defined by a second lobe, said hollow defined by a waist joining said lobes, said waist being narrower than said lobes.

3. A housed compressor as claimed in claim 2 wherein said compressor is a linear compressor.

4. A housed compressor comprising:

an elongate compressor having a piston reciprocable in a cylinder;

an elongate hollow shell surrounding said compressor and having a gases space within, where said gases space is between the cylinder and the shell, said shell providing an obstruction to substantially divide a first region of said gases space from a second region of said gases space, said obstruction being spaced from said compressor while inhibiting gases flow between said first and second regions;

a suction gases inlet to said shell gases space, and a suction gases pathway from said gases space into said cylinder;

a compressed gases path from said cylinder out of said shell; and said suction gases inlet opening to said second region, and said compressed gases path passing through said first region.

5. A housed compressor as claimed in claim 4 wherein said obstruction is formed by the outer surface of said shell having at least one significant annular hollow transverse to the axis of elongation.

6. A housed compressor as claimed in claim 4 wherein said obstruction comprises an annular constriction in said gases space.

7. A housed compressor as claimed in claim 4 wherein said shell is a generally elongate vessel and said obstruction is formed by a neck part way along its length, the inner surface of said shell being closer to said elongate compressor in the region of said neck than in said first and second regions.

8. A housed compressor as claimed in claim 4 wherein said suction gases pathway extends through said piston.

9. A housed compressor as claimed in claim 4 wherein said compressed gases path includes a discharge head connected with said elongate compressor, said discharge head including an inner wall surface defining a discharge gases chamber, an outer wall surface within said second region of said gases space, and thermal insulation between said inner surface and said outer surface.

10. A housed compressor as claimed in claim 9 wherein said thermal insulation comprises a substantially enclosed space between an inner wall and an outer wall, said enclosed space having one spatial dimension sufficiently small that said enclosed space, together with the properties of the working gas and the expected operating conditions give a Rayleigh number (Ra) less than 20,000.

11. A housed compressor as claimed in claim 1 wherein said cylinder includes:

a cylinder housing defining a cylinder wall, a valve plate defining a cylinder end and including one or more discharge openings to said compressed gases pathway, and thermal insulation sandwiched between said valve plate and said cylinder housing.

12. A housed compressor as claimed in claim 11 wherein said thermal insulation comprises a thick polymeric sealing gasket.

13. A housed compressor as claimed in claim 1 wherein said obstruction is a baffle on said shell.

* * * * *